US008701639B2

(12) United States Patent
Proulx

(10) Patent No.: US 8,701,639 B2
(45) Date of Patent: Apr. 22, 2014

(54) OPEN RAILGUN WITH STEEL BARREL SECTIONS

(76) Inventor: George Arthur Proulx, Castro Valley, CA (US)

( * ) Notice: Subject to any disclaimer, the term of this patent is extended or adjusted under 35 U.S.C. 154(b) by 0 days.

(21) Appl. No.: 13/426,399

(22) Filed: Mar. 21, 2012

(65) Prior Publication Data

US 2012/0260901 A1 Oct. 18, 2012

Related U.S. Application Data

(60) Provisional application No. 61/475,414, filed on Apr. 14, 2011, provisional application No. 61/488,614, filed on May 20, 2011, provisional application No. 61/513,729, filed on Aug. 1, 2011, provisional application No. 61/525,303, filed on Aug. 19, 2011, provisional application No. 61/549,928, filed on Oct. 21, 2011, provisional application No. 61/567,070, filed on Dec. 5, 2011, provisional application No. 61/588,498, filed on Jan. 19, 2012, provisional application No. 61/595,110, filed on Feb. 5, 2012.

(51) Int. Cl.
*F41B 6/00* (2006.01)

(52) U.S. Cl.
USPC ..... 124/3; 89/8

(58) Field of Classification Search
USPC ..... 89/8; 124/3
See application file for complete search history.

(56) References Cited

U.S. PATENT DOCUMENTS 1,370,200 A 3/1921 Fauchon-Villeplee
1,421,435 A * 7/1922 Fauchon-Villeplee ..... 124/3
4,361,761 A 11/1982 Treglio
4,424,734 A * 1/1984 Janssen et al. ..... 89/16
4,430,921 A 2/1984 Hughes
4,433,608 A 2/1984 Deis et al.
4,467,696 A 8/1984 McNab et al.
4,485,720 A 12/1984 Kemeney (Continued)

FOREIGN PATENT DOCUMENTS

CN 101021396 A 8/2007
CN 102183174 A 9/2011

OTHER PUBLICATIONS

Seth H. Myers et al., "Demonstration of Combined Spray and Evaporative Cooling of a Electromagnetic Railgun", 14th Symposium on Electromagnetic Launch, 6 pgs., Victoria, Canada, Jun. 10-13, 2008.

(Continued)

*Primary Examiner* — Bret Hayes
*Assistant Examiner* — Derrick Morgan
(74) *Attorney, Agent, or Firm* — Edward J. Radlo; Radlo IP Law Group

(57) ABSTRACT

An elongated electromagnetic railgun (1) adapted to propel a moving armature (30) through a bore (11) along the length of the railgun (1) from its breech end (21) to its muzzle end (22). The railgun (1) comprises two elongated mechanically rigid electrically conductive barrel sections (13), said sections (13) being spaced apart from each other along the length of the railgun (1). Mechanically coupled via a dielectric (18) to each barrel section (13) is an elongated current carrying rail (14) for providing electromagnetic propulsive force to the armature (30). The two rails (14) face each other across an elongated open channel, defining the bore (11). The two barrel sections (13) are electrically connected to each other at a maximum of one location of the railgun (1).

25 Claims, 16 Drawing Sheets

(56) References Cited

U.S. PATENT DOCUMENTS

| | | | | | |
|---|---|---|---|---|---|
| 4,608,908 | A | * | 9/1986 | Carlson et al. | 89/8 |
| 4,641,567 | A | * | 2/1987 | Creedon | 89/8 |
| 4,658,729 | A | | 4/1987 | Scherbath | |
| 4,714,003 | A | * | 12/1987 | Kemeny | 89/8 |
| 4,796,511 | A | * | 1/1989 | Eyssa | 89/8 |
| 4,813,332 | A | * | 3/1989 | Jasper, Jr. | 89/8 |
| 4,846,911 | A | * | 7/1989 | Tackett et al. | 156/173 |
| 4,858,511 | A | | 8/1989 | Jasper, Jr. | |
| 5,076,135 | A | * | 12/1991 | Hurn et al. | 89/8 |
| 5,138,929 | A | * | 8/1992 | Weldon et al. | 89/8 |
| 5,183,956 | A | * | 2/1993 | Rosenberg | 89/8 |
| 5,202,008 | A | | 4/1993 | Talieh | |
| 5,237,904 | A | | 8/1993 | Kuhlmann-Wilsdorf | |
| 5,272,965 | A | | 12/1993 | Loffler | |
| 5,283,763 | A | | 2/1994 | Pham et al. | |
| 5,285,763 | A | | 2/1994 | Igenbergs | |
| 5,332,422 | A | | 7/1994 | Rao | |
| 5,375,504 | A | * | 12/1994 | Bauer | 89/8 |
| 5,385,078 | A | | 1/1995 | Carey | |
| 5,391,275 | A | | 2/1995 | Mintz | |
| 5,431,083 | A | * | 7/1995 | Vassioukevitch | 89/8 |
| 5,454,289 | A | | 10/1995 | Bacon | |
| 5,483,863 | A | * | 1/1996 | Dreizin | 89/8 |
| 5,856,630 | A | * | 1/1999 | Meger | 89/8 |
| 6,000,479 | A | | 12/1999 | Ambs | |
| 6,589,407 | B1 | | 7/2003 | Subramani | |
| 6,725,759 | B1 | | 4/2004 | Kathe et al. | |
| 7,398,722 | B1 | * | 7/2008 | Sims, Jr. | 89/8 |
| 7,409,900 | B1 | | 8/2008 | Nechitailo et al. | |
| 7,503,249 | B2 | | 3/2009 | Jackson et al. | |
| 7,614,393 | B1 | | 11/2009 | Lu | |
| 8,079,352 | B1 | * | 12/2011 | Veracka et al. | 124/3 |
| 8,109,190 | B2 | | 2/2012 | Proulx | |
| 8,132,562 | B1 | | 3/2012 | Perkinson, Jr. | |
| 8,302,584 | B1 | * | 11/2012 | Lu | 124/3 |
| 8,371,205 | B1 | * | 2/2013 | Proulx | 89/8 |
| 2006/0162536 | A1 | * | 7/2006 | Frasca | 89/8 |
| 2006/0243124 | A1 | * | 11/2006 | Jackson et al. | 89/1.8 |
| 2006/0288853 | A1 | * | 12/2006 | Frasca | 89/8 |
| 2007/0277668 | A1 | * | 12/2007 | Frasca | 89/8 |
| 2008/0053299 | A1 | * | 3/2008 | Taylor | 89/8 |
| 2010/0194212 | A1 | * | 8/2010 | Proulx | 310/12.07 |
| 2012/0000450 | A1 | * | 1/2012 | Solberg | 124/3 |

OTHER PUBLICATIONS

David Allan Adams, "Naval Guns are Revolutionary", U.S. Naval Institute 2003, U.S.A.

Applied Pulsed Power, Inc., "Applied Pulsed Power Solid State Switch Products", pp. 1-3, Jun. 2003, Freevile, New York, U.S.A.

J.P. Barber et al., "A Survey of Armature Transition Mechanisms", pp. 47-51, IEEE Transactions on Magnetivs, vol. 39, No. 1, Jan. 2003, U.S.A.

J.H. Beno et al., "Active Current Management for Four-Rail Railguns", pp. 39-44, IEEE Transactions on Magnetics, vol. 27, No. 1, Jan. 1991, U.S.A.

Jack S. Bernardes et al., "Analysis of a Capacitor-Based Pulsed-Power System for Driving Long-Range Electromagnetic Guns", pp. 486-490, IEEE Transactions on Magnetics, vol. 39, No. 1, Jan. 2003, U.S.A.

Rati Bishnol, "Navy Rat Gun' Moves Forward", InsideDefense.com, Feb. 2, 2007, U.S.A.

Kershad P. Cooper et al., "Analysis of Railgun Barrel Material", pp. 120-125, IEEE Transaction on Magnetics, vol. 43, No. 1, Jan. 2007, U.S.A.

Richard S. Cowan at al., "Friction & Wear Under Very High Electromagentifc Stress", Georgia Institute of Technology, Atlanta, GA, USA, May 2004-Oct. 2004, U.S.A.

James D'Aloia et al., "Enhancement of the Compressive Strength of Kevlar-29/Epoxy Resin Unidirectional Composites", pp. 357-364, High Performance Polymers, vol. 20, Jun. 2008, first published on Dec. 11, 2007, U.S.A.

E.M, Drobyshevski at al,, "Calculating the Liquid Film Effect on Solid Armature Rat-Gun Launching", pp. 53-58, IEEE Transactions on Magnetics, vol. 35, No. 1, Jan. 1999. U.S.A.

E.M. Drobyshevski et al., "Physics of Solid Armature Launch Transition into Arc Mode", pp. 62-66, IEEE Transactions on Magnetics, vol. 37, No. 1, Jan. 2001, U.S.A.

E.M. Drobyshevski et al., "The importance of three dimensions in the study of solid armature transition in railguns", pp. 2910-2917, Journal of Physics D: Applied Phys. 32 (1999), United Kingdom.

R.L. Ellis at al., "Influence of Bore and Rail Geometry on an Electromagnetic Naval Railgun System", pp. 43-48, IEEE Transactions on Magnetics, vol. 41, 2004, U.S.A.

Thomas G. Engel et al, "Characterization of the Velocity Skin Effect in the Surface Layer of a Railgun Sliding Contact", pp. 1837-1844, IEEE Transactions on Magnetics, vol. 44, No. 7, Jul. 2008, U.S.A.

H.D. Fair, "Advances in Electromagnetic Launch Science and Technology and Its Applications", pp. 225-230, IEEE Transactions on Magnetics, vol. 45, No. 1, Jan. 2009, U.S.A.

H.D. Fair, "Electromagnetic Launch: A Review of the U.S. National Program", pp. 11-16, IEEE Transactions on Magnetics, vol. 33, No. 1, Jan. 1997, U.S.A.

Peter Graneau et al., "Railgun Recoil Forces Cannot be Modeled as Gas Pressure", pp. 4570-4571, IEEE Transactions on Magnetics, vol. 33, No. 6, Nov. 1997, U.S.A.

John E. Hatch, "Aluminum, Properties and Physical Metallurgy", p, 26, American Society for Metals, 1984, U.S.A.

Peter Y. Hsieh et al., "Mechanism of Porosity Formation in Transfer Films in Electromagnetic Launchers", pp. 319-321, IEEE Transactions on Magnetics, vol. 45, No. 1, Jan. 2009, U.S.A.

N.C. Jaitly et al., "Long Life Rotating Arc Gap Coaxial Switch for Mega-Amp, Kilo-Coulomb, High Action Switching of Multi-MJ Capacitor Banks", IEEE, pp. 643-646, 2005, U.S.A.

A.J. Johnson et al., "Elastic Waves in Electromagnetic Launchers", pp. 141-144, IEEE Transactions on Magnetics, vol. 43, No. 1, Jan. 2007, U.S.A.

Jerry F. Kerrisk, "Electrical and Thermal Modeling of Railguns", pp. 399-402, IEEE Transactions on Magnetics, vol. Mag-20, No. 2, Mar. 1984, U.S.A.

R.E. Kothmann et al., "A Thermal Hydraulic Model of Melt-Lubrication in Railgun Armatures", pp. 86-91, IEEE Transactions on Magnetics, vol. 37, No. 1, Jan. 2001, U.S.A.

Dwight Landen et al., "Eddy Current Effects in the Laminated Containment Structure of Railguns", pp. 150-156, IEEE Transactions on Magnetics, vol. 43, No. 1, Jan. 2007, U.S.A.

Donald A. Lelonis et al., "Boron Nitride Powder A High-Performance Alternative for Solid Lubrication", Momentive Performance Materials Inc., 2006-2007, U.S.A.

J.A. Leuer, "Electromagnetic Modeling of Complex Railgun Geometries", pp. 1585-1590, IEEE Transactions on Magnetics, vol. Mag-22, No. 6, Nov. 1986, U.S.A.

Levy, United States Statutory Invention Registration No. H237, Published Mar. 3, 1987, "Armature for Small Caliber Electromagnetic Launch Projectile".

John Mallick, "Phenomenological Electromagnetic Modeling of Laminated-Containment Launchers", pp. 359-363, IEEE Transactions on Magnetics, vol. 43, No. 1, Jan. 2007, U.S.A.

Jerald V. Parker et al., "Loss of Propulsive Force in Railguns with Laminated Containment", pp. 442-446, IEEE Transactions on Magnetics, vol. 35, No. 1, Jan. 1999, U.S.A.

Chadee Persad, "A Review of U.S. Patents in Electromagnetic Launch Technology", pp. 493-497, IEEE Transactions on Magnetics, vol. 37, No. 1, Jan. 2001, U.S.A.

Chadee Persad, "Railgun Tribology—Chemical Reactions Between Contacts", pp. 391-396, IEEE Transactions on Magnetics, vol. 43, No. 1, Jan. 2007, U.S.A.

Chadee Persad et al., "Railgun Tribology: Characterization and Control of Multishot Wear Debris". pp. 173-177, IEEE Transactions on Magnetics, vol. 43, No. 1, Jan. 2007, U.S.A.

Quickfield Version 5.7, Finite Analysis System, Tera Analysis, Ltd., Svendborg, Denmark, 2009, http://quickfield.com (last download Nov. 1, 2010).

(56) References Cited

OTHER PUBLICATIONS

Richard F. Salant et al., "Simulation of Liquid Lubricant Injection in Electromagnetic Launcher Armatures", pp. 364-369, IEEE Transactions on Magnetics, vol. 43, No. 1, Jan. 2007, U.S.A.
Jerome T. Tzeng, "Dynamic Response of Electromagnetic Railgun Due to Projectile Movement", IEEE Transactions on Magnetics, vol. 39, No. 1, Jan. 2003, U.S.A.
W.A. Walls et al., "Applications of Electromagnetic Guns to Future Naval Platforms", pp. 262-267, IEEE Transactions on Magnetics, vol. 35, No. 1, Jan. 1999, U.S.A.
L.C. Woods, "The Current Melt-Wave Model", pp. 152-156, IEEE Transactions on Magnetics, vol. 33, No. 1, Jan. 1997, U.S.A.
Toensmeier, "Navy plans to demonstrate rail gun by 2011: U.S. Navy is moving forward with electromagnetic rail gun,"Aviation Week & Space Technology, Jul. 31, 2006, p. 529, U.S.A.
Hahne, J. J., Herbst, J,H., and Upshaw, J.L., "Fabrication and Testing of a 30 mm and 90 mm Laminated, High L'Railgun Designed and Built at CEM-UT", IEEE Transactions on Magnetics, vol. 31, No. 1, Jan. 1995, pp. 303-308, U.S.A.
Engel, Thomas G., Neri, Jesse M., and Nunnally, William C., "Efficiency and Scaling of Constant Inductance Gradient DC Electromagnetic Launchers", IEEE Transactions on Magnetics , vol. 42, No. 8, Aug. 2006, pp. 2043-2051, U.S.A.
International Search Report (ISA/AU) mailed Sep. 12, 2013 for International patent application PCT/US2013/022302 filed Jan. 18, 2013, 5 pages.
Written Opinion of the International Searching Authority (ISA/AU) mailed Sep. 12, 2013 for international patent application PCT/US2013/022302 filed Jan. 18, 2013, 7 pages.

* cited by examiner

OPEN RAILGUN WITH STEEL BARREL SECTIONS

RELATED APPLICATIONS

This patent application claims the benefit of commonly-owned U.S. provisional patent applications 61/475,414 filed Apr. 14, 2011; 61/488,614 filed May 20, 2011; 61/513,729 filed Aug. 1, 2011; 61/525,303 filed Aug. 19, 2011; 61/549,928 filed Oct. 21, 2011; 61/567,070 filed Dec. 5, 2011; 61/588,498 filed Jan. 19, 2012; and 61/595,110 filed Feb. 5, 2012; all eight of which previously-filed patent applications are hereby incorporated by reference in their entireties into the present patent application.

TECHNICAL FIELD

This patent application pertains generally to the field of electromagnetic launchers, and specifically to railguns.

BACKGROUND ART

Background references include the following references, all of which are hereby incorporated in their entireties into the present patent application:

1. "Electrical and Thermal Modeling of Railguns", Kerrisk, Jerry F., *IEEE Transactions on Magnetics*, Vol. Mag-20, No. 2, March 1984, pp. 399-402, U.S.A.
2. "Loss of Propulsive Force in Railguns with Laminated Containment", Parker, Jerald V., and Levinson, Scott, *IEEE Transactions on Magnetics*, Vol. 35, No. 1, January 1999, U.S.A.
3. "Eddy Current Effects in the Laminated Containment Structure of Railguns", Landen, Dwight and Satapathy, Sikhanda, *IEEE Transactions on Magnetics*, Vol. 43, No. 1, January 2007, U.S.A.
4. "Phenomenological Electromagnetic Modeling of Laminated-Containment Launchers", Mallick, John, *IEEE Transactions on Magnetics*, Vol. 43, No. 1, January 2007, U.S.A.
5. "Enhancement of the Compressive Strength of Kevlar-29/Epoxy Resin Unidirectional Composites", D'Aloia et. al, *High Performance Polymers*, Vol. 20, pp. 357-364, June 2008, first published December 11, 2007.
6. Quickfield Version 5.7, Finite Analysis System, Tera Analysis, Ltd., Svendborg, Denmark, 2009, http://quickfield.com (last downloaded Nov. 1, 2010)

Kerrisk [Reference 1] taught that a gun barrel electrically conductive along the major gun axis could not be brought into close proximity to the current carrying rails of a railgun without significantly reducing rail inductance. Given the barrel geometry, which was fully enclosing of the rails, and the other boundary conditions used, the conclusions arrived at were correct.

However, consider the following. The gas law is represented by a scalar equation and hot gas produces an isotropic pressure. Consequentially, the barrel for a standard gun must be everywhere continuous in theta and z to prevent gas escape and force loss on the back projectile surface. On the other hand, the magnetic field is defined by Maxwell's equations, and the magnetic field is a vector quantity. It follows that the magnetic pressure is a vector quantity. The barrel design for a magnetic gun can take advantage of this fundamental difference between these two cases. It is not necessarily required that the barrel be continuous in theta and z for full magnetic pressure containment and for the magnetic pressure to be properly applied to the back armature surface. That is, the barrel need not be fully enclosing of the rails.

If the electrically conducting gun barrel: (1) is split open top and bottom from the breech to the muzzle, and (2) the two new barrel sections make contact with each other only at the gun base (i.e., the gun breech), the condition for completing the image current circuit in the armature region can no longer occur, as discussed by Kerrisk [Reference 1]. This represents the case where each of the two independent barrel sections is mechanically anchored to the gun base with direct metal-to-metal mechanical contact. Therefore, the barrel sections are electrically connected to each other at the base. However, the two barrel sections remain electrically isolated from each other everywhere else along the length of the gun barrel. This new barrel configuration is described herein.

DISCLOSURE OF INVENTION

An elongated electromagnetic railgun (1) adapted to propel a moving armature (30) through a bore (11) along the length of the railgun (1) from its breech end (21) to its muzzle end (22). The railgun (1) comprises two elongated mechanically rigid electrically conductive barrel sections (13), said sections (13) being spaced apart from each other along the length of the railgun (1). Mechanically coupled via a dielectric (18) to each barrel section (13) is an elongated current carrying rail (14) for providing electromagnetic propulsive force to the armature (30). The two rails (14) face each other across an elongated open channel, defining the bore (11). The two barrel sections (13) are electrically connected to each other at a maximum of one location of the railgun (1).

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
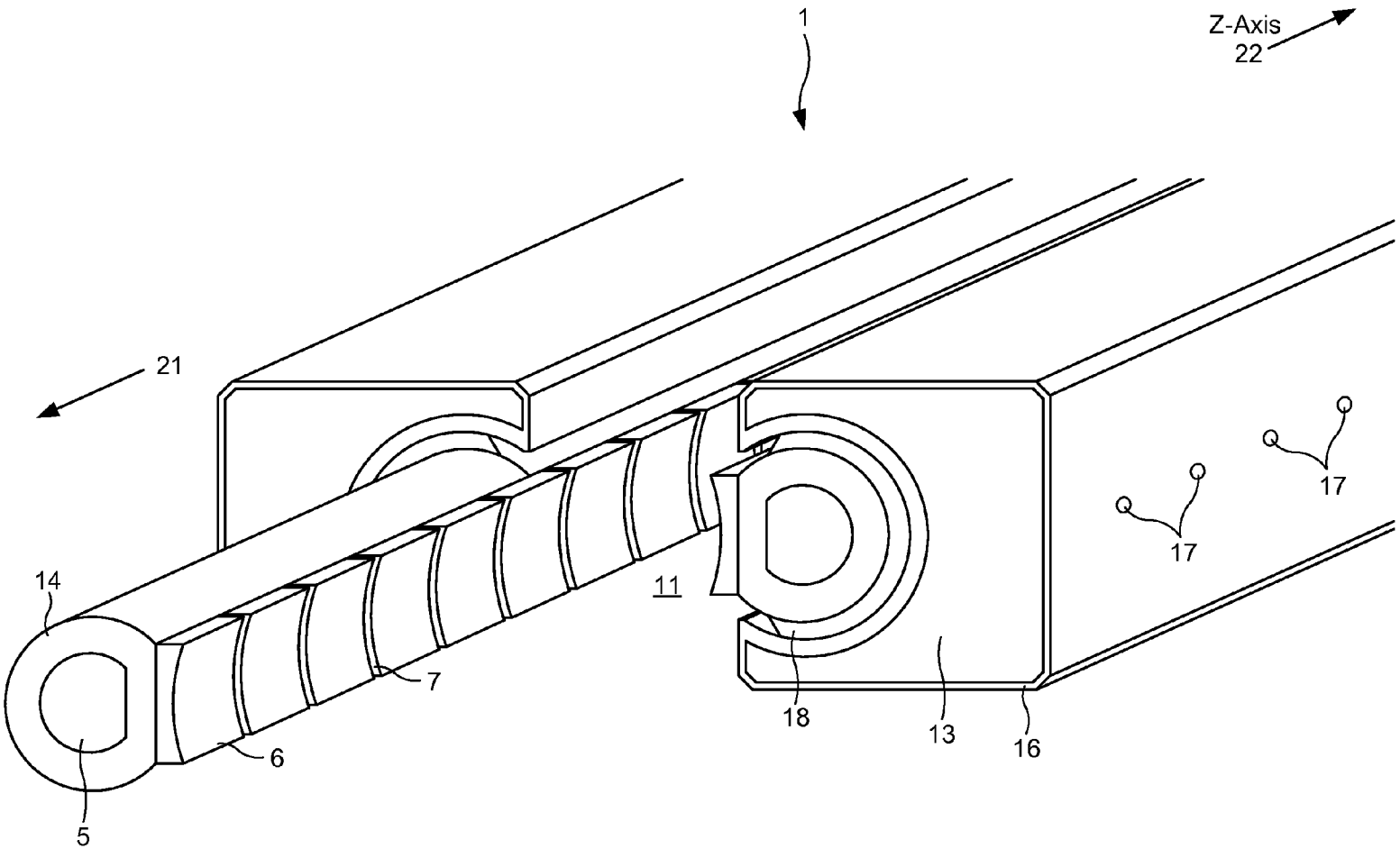
FIG. 1 is an exploded isometric view of one embodiment of railgun 1 of the present invention.

By electrically isolating two specially designed electrically conductive gun barrel sections 13 along their lengths from breech 21 to muzzle 22, the present invention changes the boundary conditions used in the 1984 paper by Kerrisk [Reference 1]. The result allows a metal gun barrel 13 to be located close to the current carrying rails 14 while still maintaining high inductance per unit length (L'). The following is a description of a two-rail 14 open air railgun 1 that uses this principle to achieve high efficiency. Each current carrying rail 14 is mechanically supported by its own barrel section 13. The rails 14 are normally identical to each other, and are spaced apart from each other along the entire length of the railgun 1. The space between the rails 14 defines the gun bore 11. The bore 11 is directly exposed to the atmosphere (ambient gases) along its entire length.

First Principal Embodiment

FIG. 1 shows an isometric view of a first principal embodiment of the present invention. The spacing between the rails 14 is typically 30 cm for the particular design used to calculate results discussed here, including the inductance (L'=0.40 uH/m) and the magnetic computational outputs presented below. The results presented are not optimized at the system level. For example, with all else being held constant, if the gun bore 11 is increased from 30 cm to 40 cm, L' increases from 0.40 uH/m to 0.47 uH/m.

In this two-rail 14 system, current is carried along the first rail 14, conducted across a moving armature 30 (see FIG. 2), and then returned in the opposite direction along the second, parallel, and opposing rail 14.

Image currents create the opportunity for a two-part rail 14,6. The first part 6, where sliding contact between the rail 6 and the armature 30 is made, is made of steel or a similar highly wear-resistant material. The second part 14, which makes up the bulk of the rail 14,6 and which carries the bulk of the current to and from the generator, is made of copper or copper alloy. This design allows for a large enough rail 14,6 size to both accommodate rail 14,6 cooling and a reduced resistance per unit length, to more than counter the increased power loading due to the introduction of image currents on the outer surfaces of barrel sections 13.

Circular rail part 14 is preferably recessed within its corresponding barrel section 13. While other materials could be used for plate 6, steel is usually the material of choice, even though the thermal expansion coefficients of steel and copper alloys are quite different. Other materials, such as tungsten alloy, tungsten copper eutectic, or a tungsten copper alloy, could be used for plate 6. This would better match the CTE's of the two parts 14,6.

Plate 6 is explosion bonded, or otherwise firmly attached, to the copper alloy rail part 14. Each plate 6 preferably has small periodically spaced slots 7. The slots 7 are perpendicular to the long (z) axis of the rail 14,6. Slots 7 extend all the way through plate 6. In this way, as the copper 14 expands and contracts at a greater rate than the steel 6, the small sections of steel 6 can absorb the small differential stresses and strains that occur as the temperature cycles between each railgun 1 shot.

In an alternate embodiment, the two parts 14,6 of the rail can be replaced with a single part 14 made entirely out of a single material, such as tungsten copper alloy.

The copper or copper alloy part 14 contains a large continuous or sectional channel 5 interior to the rail part 14. Channel 5 allows for the flow of coolant, either along the entire rail 14,6 length, or, preferably, along a plurality of rail 14,6 sections. In this embodiment, holes 17 can be machined into the barrel sections 13, and coolant can be exchanged at varying gun 1 locations. The total heat deposited varies along the rail 14,6. Therefore, rail 14,6 cooling can be better managed in sections, as provided by this embodiment, While not shown, the gun barrel 13 can be cooled independently of the rails 14,6.

The barrel sections 13 provide structural integrity to the railgun 1. In conjunction with the retention frames 32, sections 13 contain the strong outward lateral forces that are produced by the magnetic pressure from the (typically very high) currents flowing through the rails 14,6.

Figure 6:
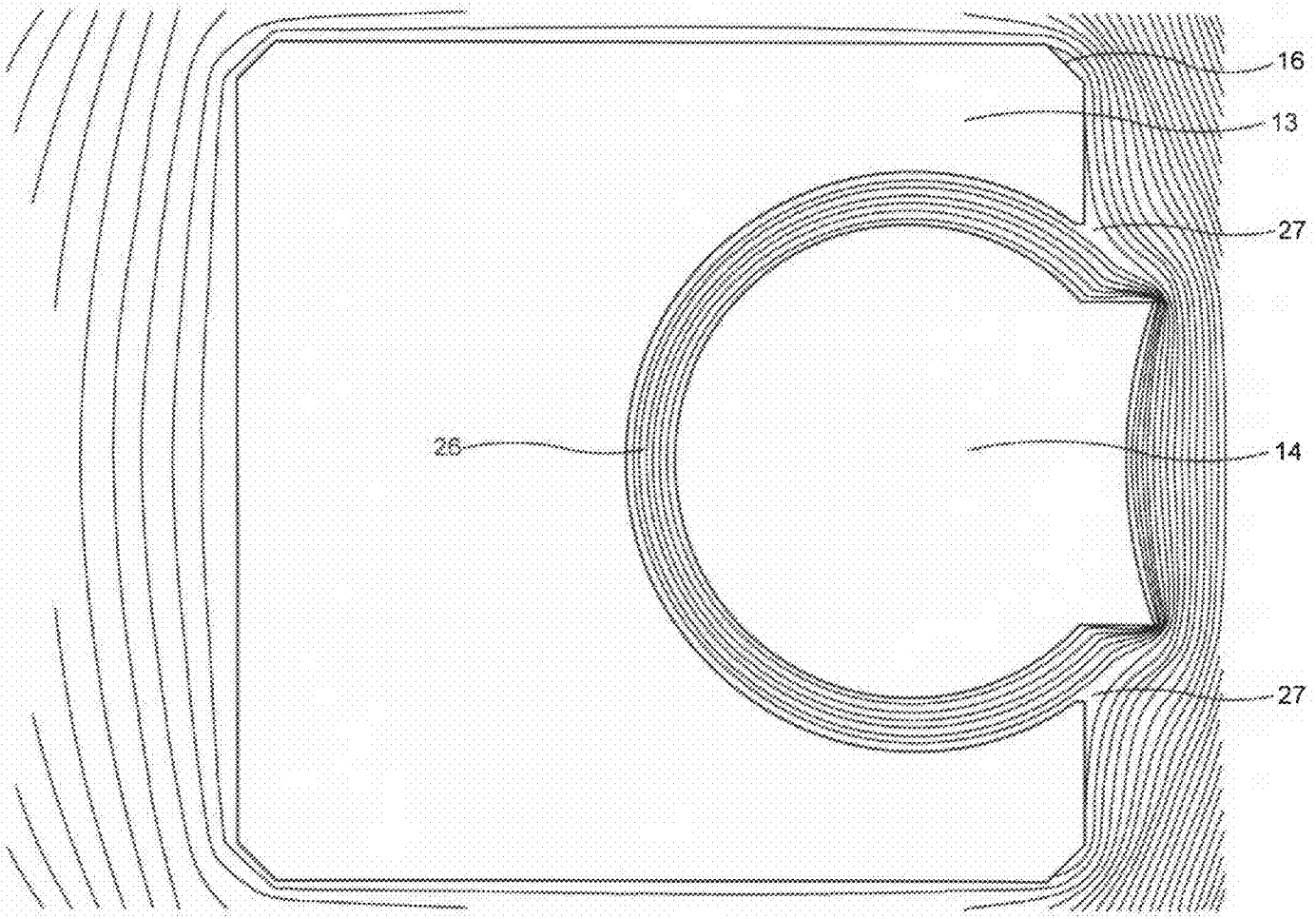
FIG. 6 is a closeup of a portion of the magnetic field line plot of FIG. 5.
Figure 7:
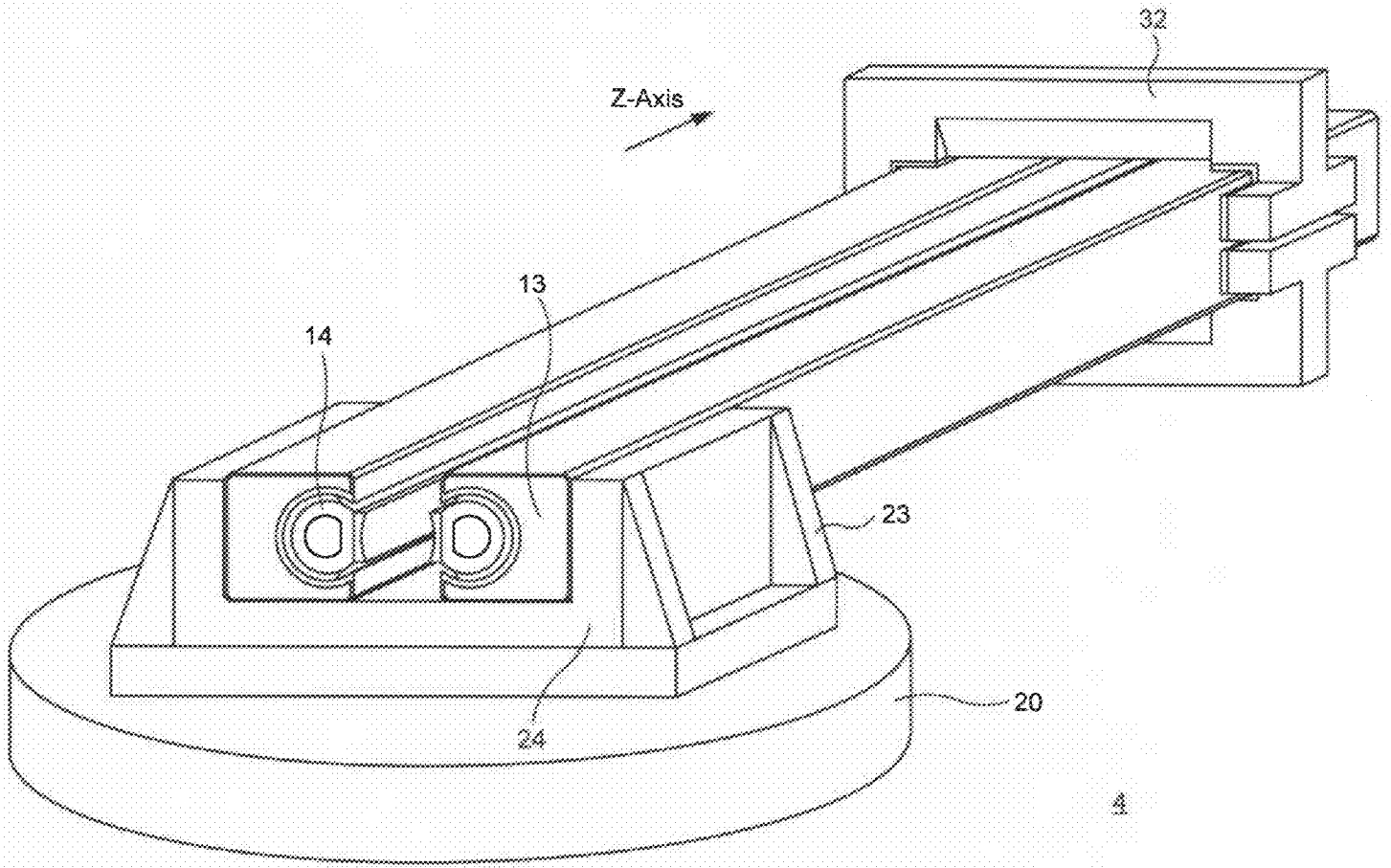
FIG. 7 is an isometric view of the FIG. 1 embodiment showing a first means for electrically coupling the barrel sections 13 to each other at the base 23.
Figure 8:
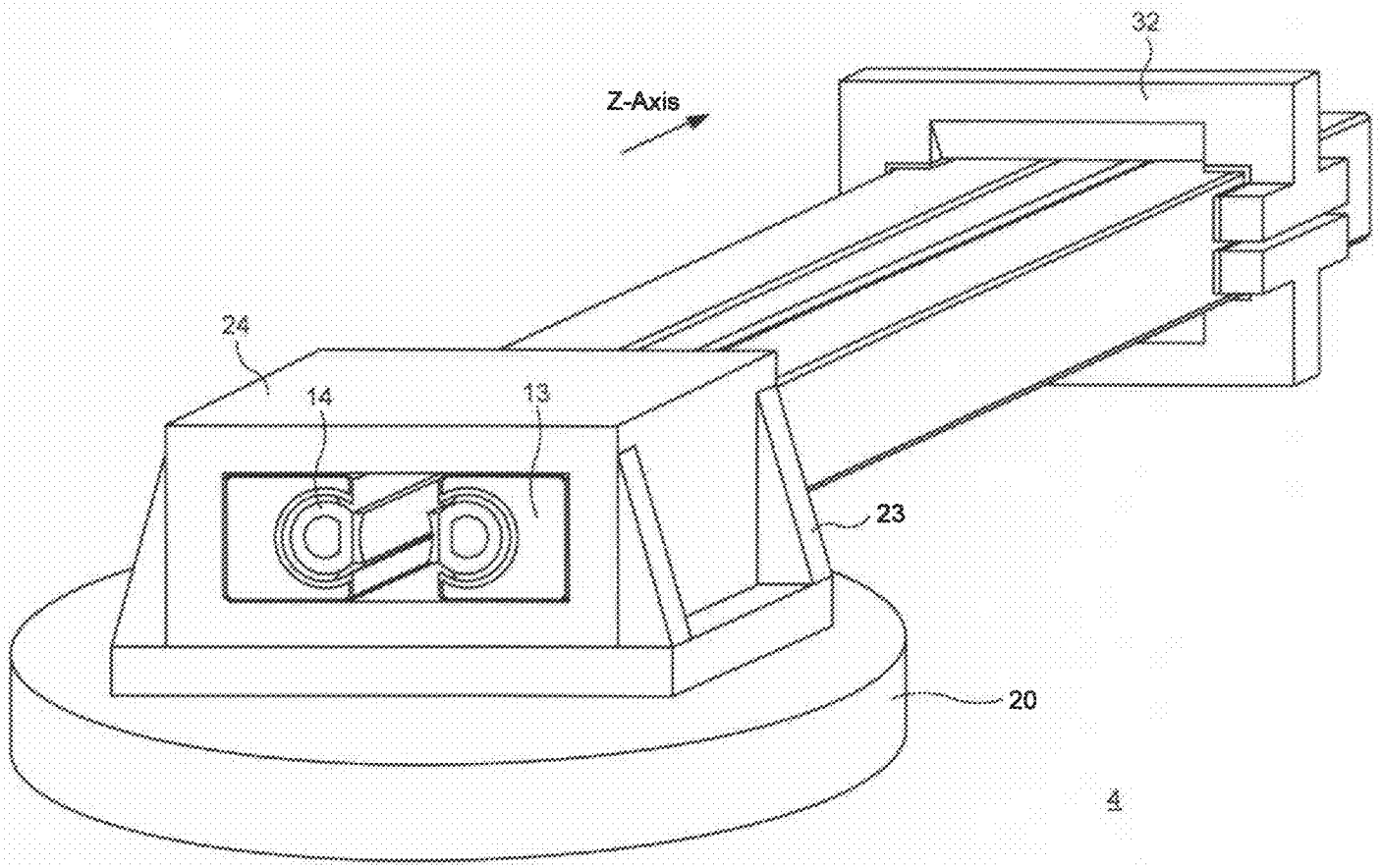
FIG. 8 is an isometric view of the FIG. 1 embodiment showing a second means for electrically coupling the barrel sections 13 together at the base 23.
Figure 9:
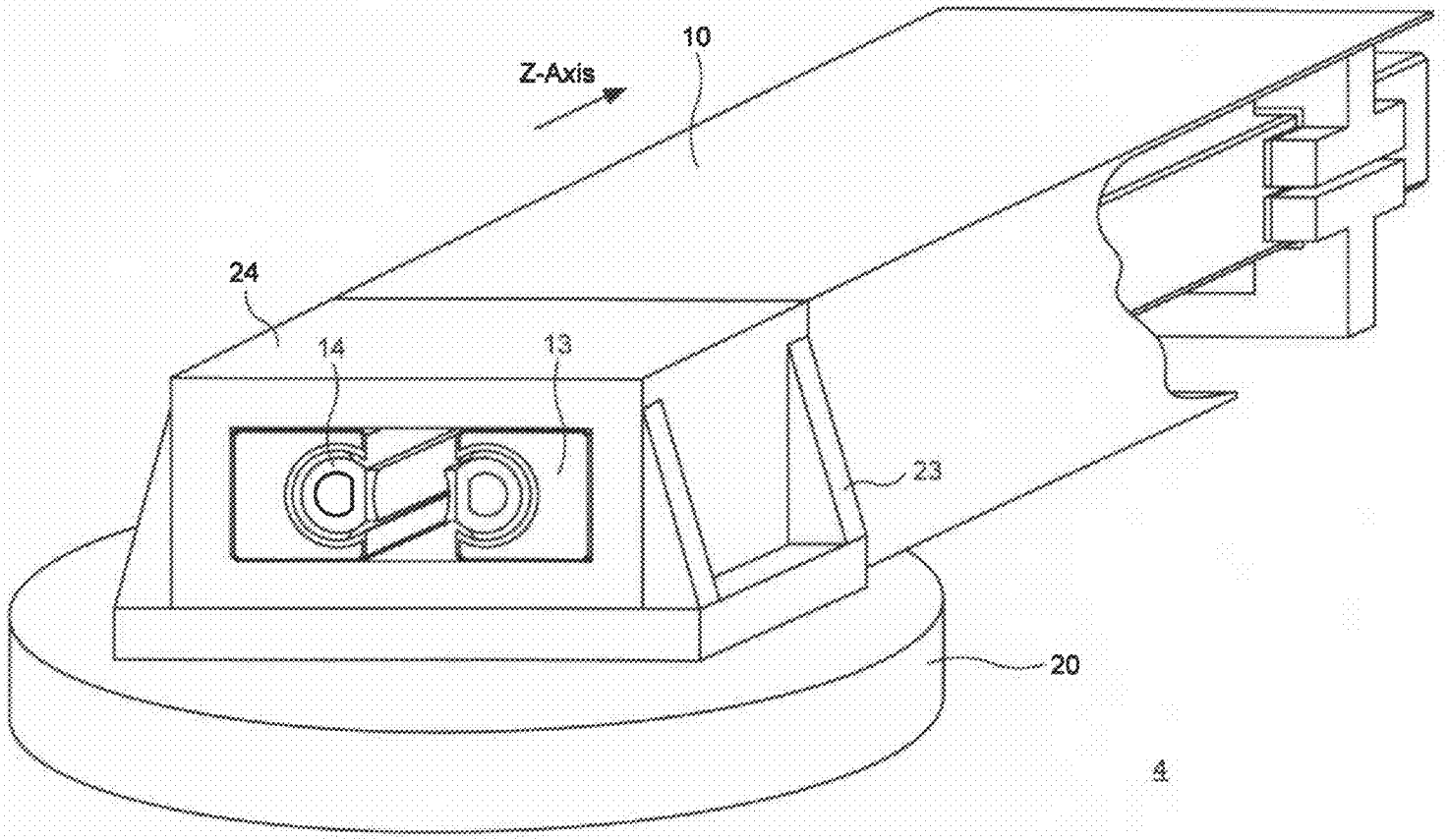
FIG. 9 is an isometric view of the embodiment of FIG. 8 in which a dielectric shell 10 has been added.

Typically, the two barrel sections 13 are electrically connected to each other at just one location along the length of the gun 1, namely, at the region of the base 23, as shown in FIGS. 7, 8, and 9. However, in some embodiments, the two barrel sections 13 are not electrically connected to each other or to any other electrically conductive mass (e.g., base 23, turret 20, or deck 4) at all, i.e., they are made to "float" electrically. This "electrically floating" design can be used for all the embodiments illustrated herein, i.e., those depicted in FIGS. 1 through 6, as well as FIGS. 10 through 16.

Barrel sections 13 are typically made of a high-strength metal, such as steel. The outer surfaces of the barrel sections 13 may be lined with electrically conductive linings 16, so that these outer surfaces are electrically conductive to a higher degree. This facilitates the return of image currents from the muzzle end 22 to the breech end 21 with lower losses. When used, linings 16 are fabricated of a very highly electrically conductive material, such as copper or copper alloy.

The two barrel sections 13 are spaced apart from each other, at a uniform distance, throughout the length of the railgun, and are normally identical to each other.

Figure 2:
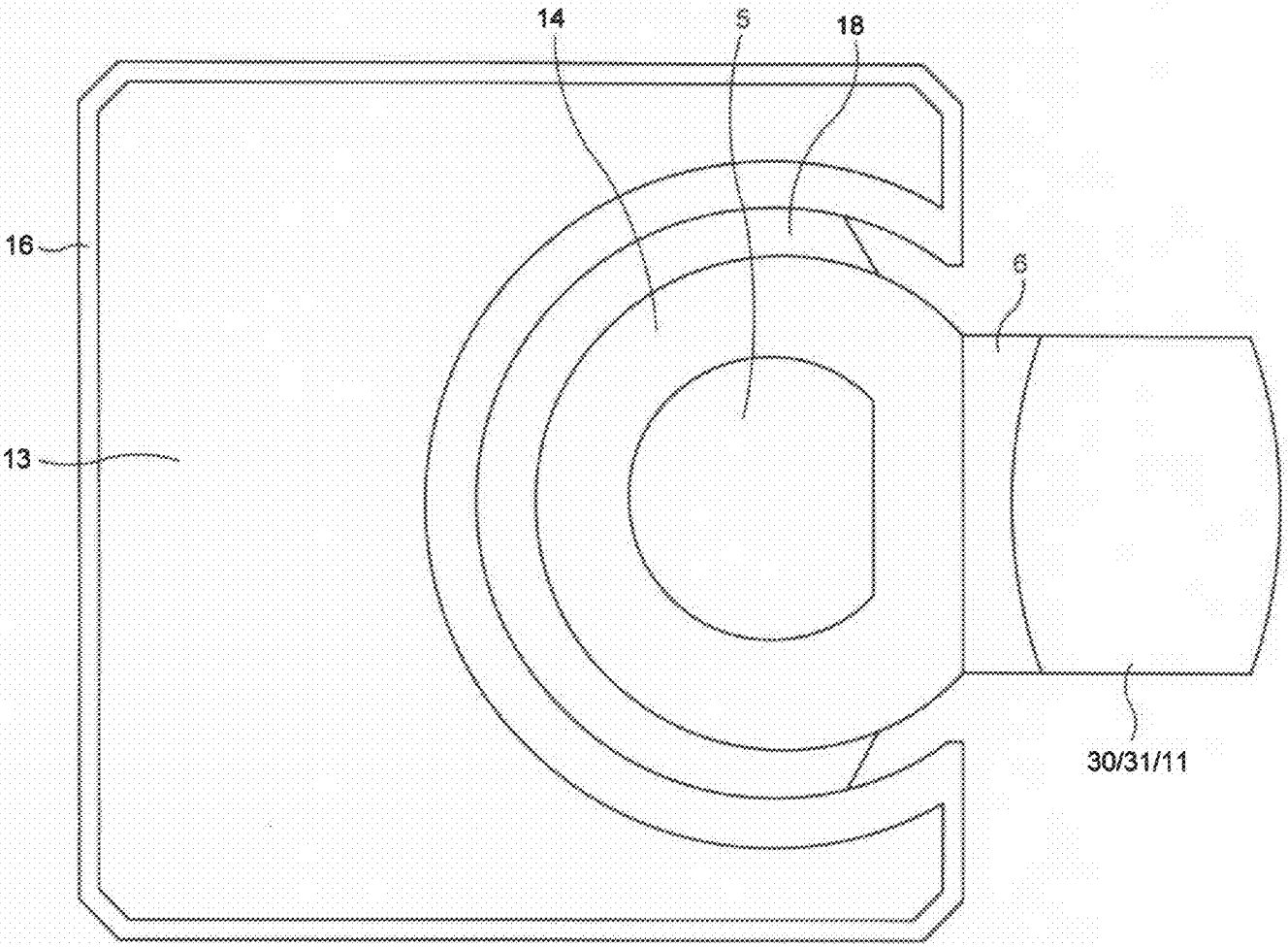
FIG. 2 is a cross-sectional view of the FIG. 1 embodiment.

FIG. 2 is a cross-sectional view of a barrel section 13 and its embedded current carrying rail part 14. In this particular embodiment, barrel section 13 has a square or non-square but rectangular cross-section. Typical dimensions are 55 cm×52 cm for the cross-section of barrel section 13, 30 cm diameter for rail part 14, and 2.5 cm thickness for insulator 18. The gun bore 11 is represented by the volume between the two facing steel plates 6. FIG. 2 illustrates the left-hand plate 6. The bore 11 volume is entirely open to the atmosphere (ambient gases) from the breech 21 to the muzzle 22, except when armature 30 and any accompanying projectile 31 pass through the bore 11. Armature 30 can itself be the payload, or it can propel a separate projectile 31 which constitutes the payload.

In many embodiments, such as illustrated in FIG. 2, the barrel 13 surfaces are lined with copper or copper alloy lining 16. In some circumstances, such as to save weight, aluminum or aluminum alloy might be used for linings 16. The region between the current carrying rail parts 14 and the gun barrel 13 is mostly filled with a dielectric 18. Kevlar is the dielectric 18 of choice, although in other applications, Phenolic, ceramic, or a ceramic composite can be used. The geometry is designed to insure that there is no direct line of sight between the dielectric 18/air interface and the sliding contact region between the rail 14,6 and the armature 30. The purpose of this geometrical constraint is to prevent direct UV illumination of these surfaces. It also prevents direct liquid metal (emanating from the armature 30/rail 14,6 interface) or other direct sputtering or evaporative induced coating of the insulator 18 surface. Additional baffles can be added to further protect this dielectric 18/air interface, if required.

Plate 6 is concave (from the point of view of bore 11). This allows for an effective mechanical capture and guidance of the armature 30 and payload 31 along the gun bore 11. It also helps to insure that any liquid metal jetted from the rail 14,6/armature 30 interface will be ejected directly into the outside region of the gun 1 and well away from the insulators 18.

Figure 3:
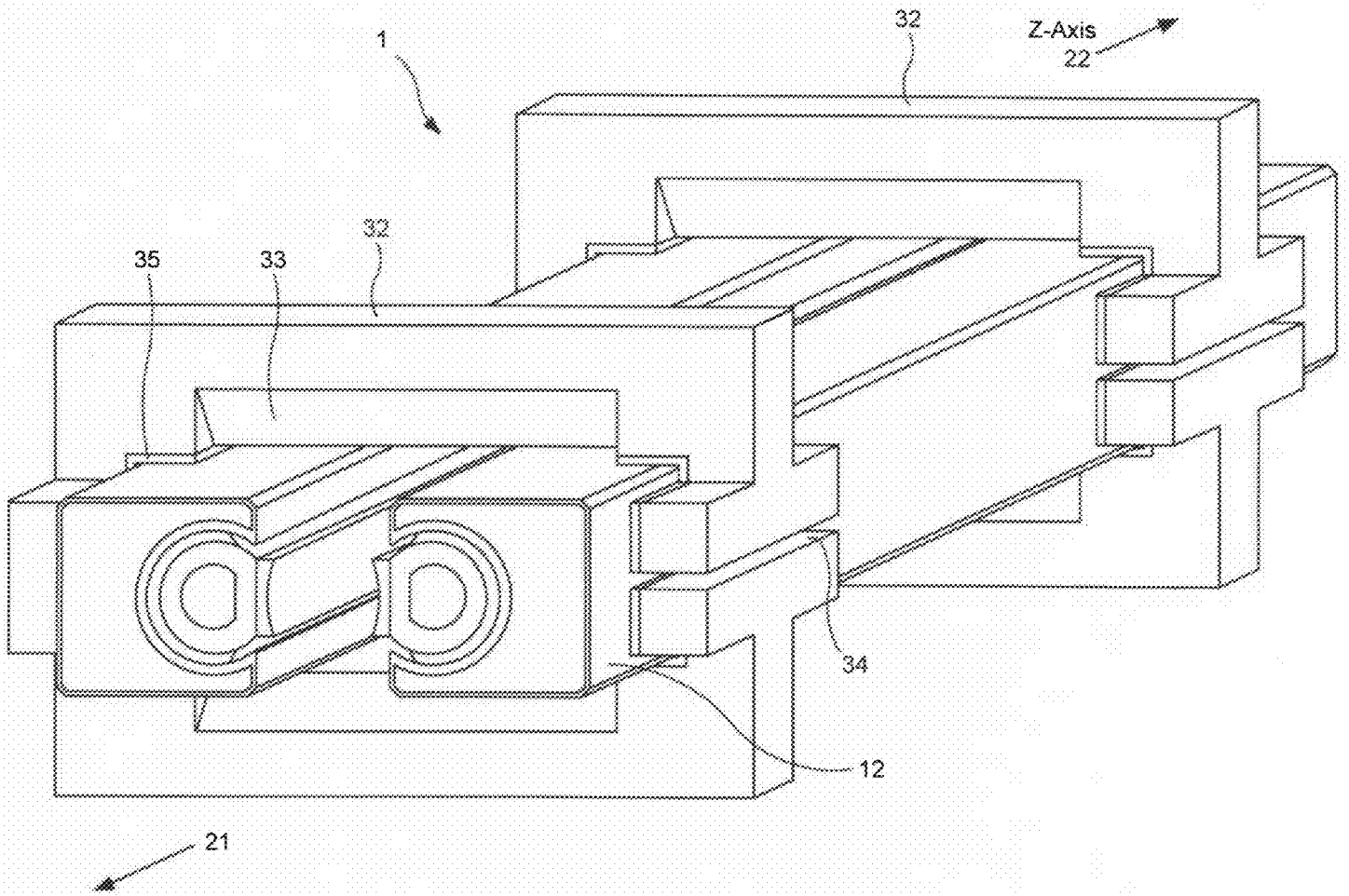
FIG. 3 is an isometric view of the embodiment of FIG. 1 in which retention frames 32 are used.

FIG. 3 shows two of the retention frames 32 that hold the barrel sections 13 in place during a shot. In practice, several retention frames 32 are used, spaced apart along the length of the gun 1. FIG. 3 shows a partial assembly of the barrel sections 13 at a region other than the region near the base 23 and turret 20. All inward facing surfaces of the retention frames 32 that would otherwise come in contact with the electrically conductive barrel 13 surfaces are lined with Kevlar or other suitable dielectric 35. This is to prevent the electrical interconnection of the two barrel sections 13 with each other. These dielectric sections 35, like dielectrics 18, are always under compression.

Figure 4:
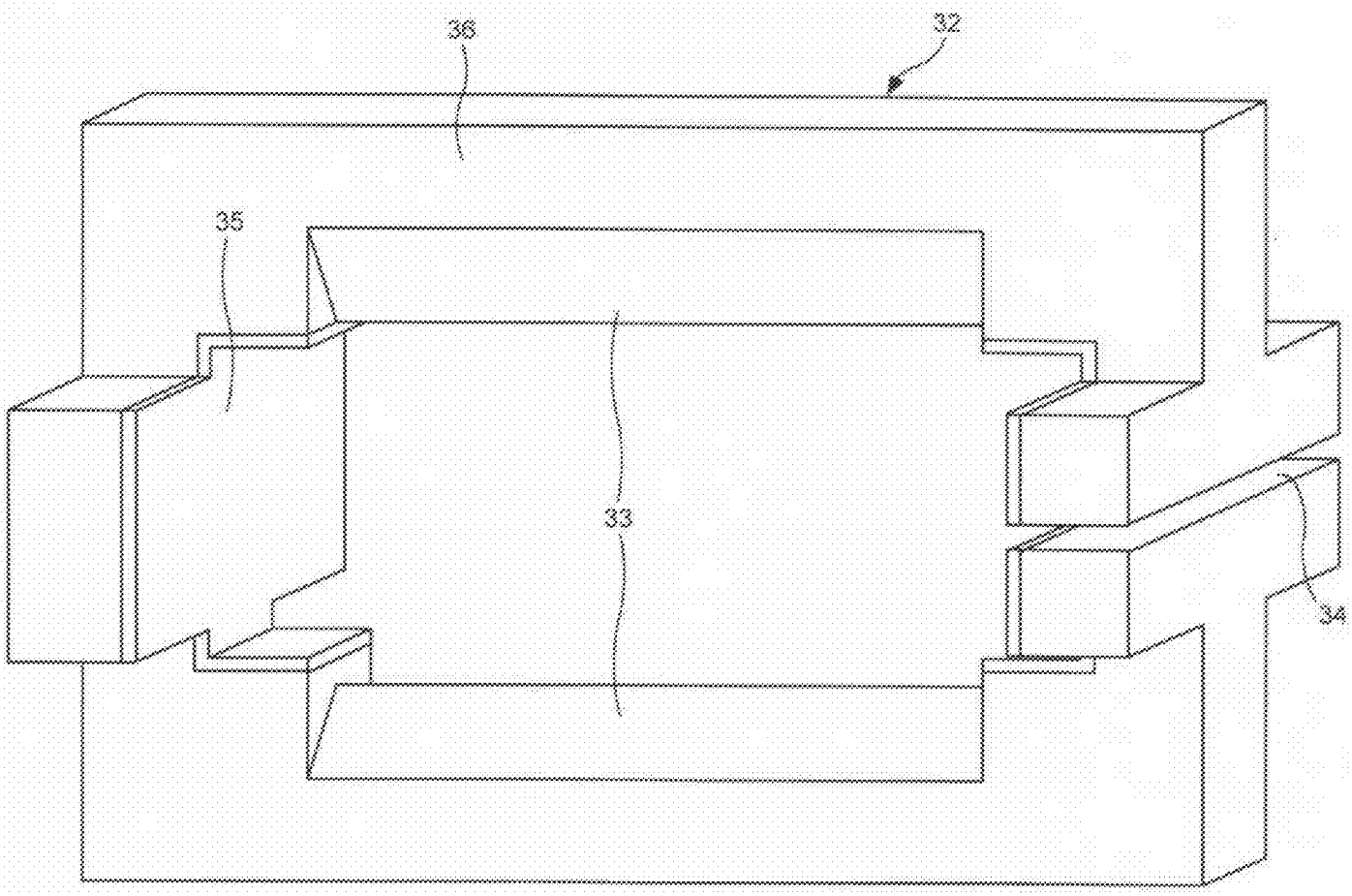
FIG. 4 is an isometric view of a retention frame 32.

As shown in FIGS. 3 and 4, each frame 32 has two wedge sections 33 with sharp edges, positioned on the top and bottom of the frame 32. Wedges 33 prevent the hot, high velocity liquid metal that is jetted from the armature 30/rail 14,6 interface from coming into contact with this portion of the retention frames 32. The sharp edges are used to prevent any appreciable backsplash of the hot liquid metal. The liquid metal is released into the atmosphere, where it is burned off.

During the short periods that the jetted liquid metal comes into contact with any of the retention frames 32, an alternate conducting path is produced for current flow between the rails 14,6 other than through the armature 30. This current path is highly resistive and highly inductive compared to the normal path through the armature 30. Therefore, relatively little current flows along this path. The retention frames 32 can be coated with a non-conductor along their beveled surfaces 33 to prevent current flow along this path.

The pitch of the retention frames 32 (distance between adjacent frames 32 along the z axis) is large compared to the thickness of each frame 32. This is important so as not to reduce the rail 14,6 inductance appreciably. This also helps keep the added weight in check and is possible for two reasons. The frame 32 height can be increased as necessary to insure that the induced stress in the frame 32 due to the rail 14,6 current-induced magnetic pressure is well within the stress limit of the (typically steel) material from which the frames 32 are fabricated. Secondly, the barrel sections 13 are substantial in physical size and prevent outward deflection of the rails 14,6 in the regions between retention frames 32.

Each retention frame 32 contains at least one (typically horizontal) separation slot 34, cut completely through the frame 32, located in the vicinity of a gun barrel 13 back surface 12. This prevents the complete encirclement of the rails 14,6 by a conductor which would otherwise reduce the gun 1 inductance per unit length [References 2, 3, 4]. Because of the size and design of the retention frames 32, these slots 34 do not compromise the frame's 32 structural integrity. The large frame size 32 on the barrel backside 12 reduces the inductance only marginally, as the flux density in this region is low. The conservative computer modeling estimate for this flux density is approximately between 0.2% and 0.3%.

Figure 5:
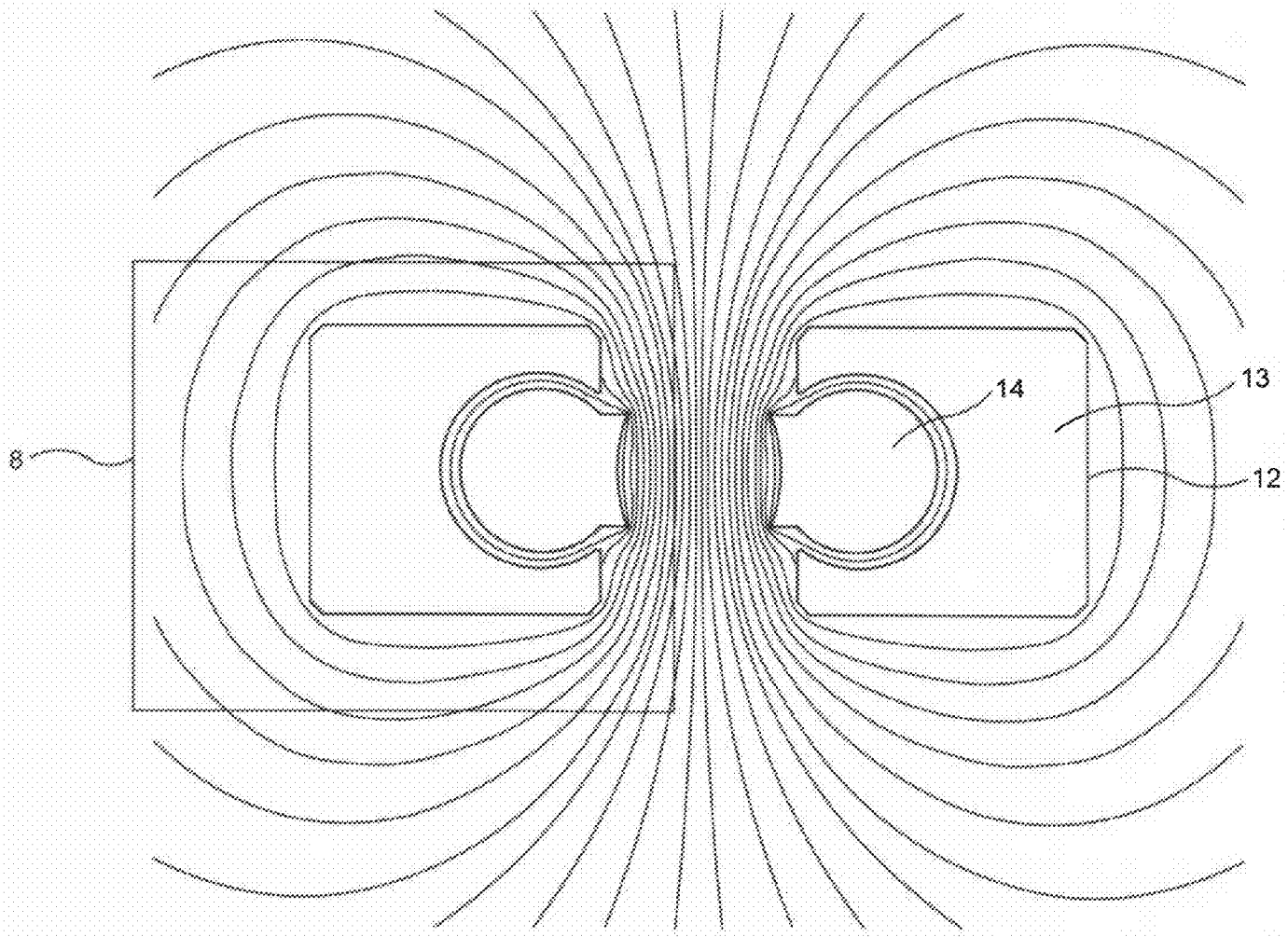
FIG. 5 is a magnetic field line plot for the embodiment of FIG. 1.

The following is a calculation of the cross-sectional area of the retention frames 32 required to prevent separation of the rails 14,6 so that the retention frames 32 do not fail. Superimposed on FIG. 5 is a contour 8 used for the computer-based net outward force calculation ($1.2\times10^7$ N/m) for a current of 6 MA flowing in each current carrying rail part 14. A tensile strength of 800 MPa for heat treated steel is assumed.

$$1\ \text{MPa}=1\times10^2\ \text{N/cm}^2$$

Therefore, the yield strength of steel (800 MPa) is:

$$8\times10^4\ \text{N/cm}^2$$

The cross-sectional area per unit length along the gun bore 11 axis required to prevent lateral rail 14,6 expansion at the yield strength of the material is then:

$$(1.2\times10^7\ \text{N/m})/(8\times10^4\ \text{N/cm}^2)=1.5\times10^2\ \text{cm}^2/\text{m}$$

For a 400% engineering safety margin, this becomes:

$$6.0\times10^2\ \text{cm}^2/\text{m}$$

For every meter along the gun bore 11 length, the steel cross-sectional area that spans the bore 11 region required with a safety factor of 400% is given by the above. Because there are two segments (one on the top and one on the bottom) to each retention frame 32 that spans the gun bore 11, each such steel cross-section is 300 $\text{cm}^2$. If each frame 32 element were 30 cm in height, the retention frame 32 width would be 10 cm. This represents a mechanical transparency factor of 90%. However, the magnetic transparency factor will be higher, as the flux lines are ducted around the frames 32, preserving a high degree of the energy density on both sides of the frame 32. However, and for example, the optimized mechanical design might call for two retention frames 32 per meter, each 5 cm in width.

The 400% engineering safety margin accounts for a number of factors, including mechanical safety to failure. Of equal importance are such factors as magnetically induced lateral rail 14,6 displacement at the point of armature 30 contact. The overall mechanical system must be sufficiently rigid to insure that rail 14,6 spacing and planarity specifications are met.

The compressive strength of Kevlar is variously given in the literature as being between 200 Mpa and 300 Mpa, and with heat treatment can be as high as 500 MPa [Reference 5]. The insulation 35 surface area used on the backsides 12 of the barrel sections 13 can be designed to accommodate similar engineering safety margins as that used above.

Magnetic Analysis

FIG. 5 shows a two-dimensional magnetic field line plot for the embodiment where the two barrel sections 13 are electrically connected to each other at the gun base 23 only. The two barrel sections 13 remain electrically isolated from each other everywhere else along the gun barrel 13 length, from the breech 21 to the muzzle 22. Physically, this means that the two barrel sections 13 are mechanically secured to the gun base 23 with direct metal-to-metal connections. The retention frames 32 were not included in the computer run that was used for FIG. 5. Inclusion of frames 32 would alter the results by approximately 2% to 3%. The field line plot of FIG. 5 was taken 100 micro-seconds into the pulse. Copper was used to simulate the barrel sections 13. This simulated the copper linings 16 typically used around steel barrel 13 walls. Due to computer program limitations, each plate 6 was simulated using copper fused with its corresponding copper rail part 14. There was no accounting for transient thermal heating of the electrodes 14 that would otherwise drive the surface currents deeper into the electrodes 14 with time. Version 5.7 of Quickfield [Reference 6] was used for all computational work presented herein.

A substantial amount of additional steel can be added to the gun barrel sections 13 without compromising the railgun 1 inductance. For example, in one computer simulation in which a substantial amount of steel was added laterally to the backside 12 of each barrel section 13, the inductance per unit length decreased from 0.40 uH/m to 0.39 uH/m. This is approximately a 2.5% reduction in the inductance.

FIG. 6 shows an enlargement of the space around one of the current carrying copper rails 14,6. The field line density has been increased to show more precisely where the surface currents will flow after the armature 30 has passed and before significant current diffusion into the conductors 14,6 has occurred. Drive currents flow on the surfaces of rail 14,6, and image currents flow on surfaces of the steel barrel 13. Once the armature 30 has passed, a high percentage of the rail 14,6 current is drawn into the small gap 26 between the copper rail part 14 and the barrel 13. By proper design, the rail 14,6 current is initially distributed uniformly over the significantly enhanced surface area of the enlarged rail 14,6,26. Later, as the current diffuses into the bulk of the rail 14, it does so more uniformly. This minimizes energy dissipation in the rail 14,6.

What is not shown accurately in FIG. 6, as Version 5.7 of Quickfield is unable to simulate such, is that due to the higher resistivity of the steel plate 6, compared with the copper rail part 14, a higher percentage of the rail 14,6 current on the front surface quickly migrates to the copper part 14 than is shown in FIG. 6. Some of the surface current immediately migrates to the copper 14 surface because of the relatively higher resistivity of the steel 6. Second, the higher steel 6 resistivity and ensuing heating of this material then drives additional surface current to the copper 14 surface, and leads to faster current diffusion into the bulk steel 6 and subsequent flow in the underlying copper part 14. Version 5.7 of Quickfield does not dynamically simulate material temperature increases and self-correct for these related resistivity changes.

Each separatrix 27 shown in FIG. 6 denotes a location on the barrel 13 surface where the surface current changes direction. These currents reconnect at the base 23 region, where the rail 14,6 currents originate, and in the vicinity of the armature 30. Energy flow into the combined rail 14,6 and copper lining 16 can be relatively low, as compared to existing railgun designs. In addition, the design described in this patent application allows for multiple firings, as the rails 14,6 are actively cooled.

The barrel 13 surface current density is highest on the surface that faces the copper rail part 14. It is of value that the lining 16 be particularly thick in this region, as shown in FIG. 2. The area over which the image currents flow in the opposite direction is substantially larger, the surface current densities are lower there, and therefore the lining 16 thickness can be thinner there. See FIGS. 2 and 6. Adjustment of the lining 16 thickness in this region can be further adjusted, based on the specific surface current density distribution around the barrel 13 circumference.

FIGS. 7, 8, and 9 illustrate different techniques for electrically coupling the two barrel sections 13 together at the base 23. FIG. 7 illustrates an electrically conductive clamping member 24, generally in the shape of the letter "C" lying on its back, positioned at the base 23 region. Clamping member 24 provides mechanical support as well as electrical connectivity between the two barrel sections 13. In each of FIGS. 7, 8, and 9, member 24 can be as long (in the z direction) as needed for its mechanical purposes, although lengthening member 24 causes a reduction in L' in the regions of the base 23. Clamping member 24 is supported by and electrically connected to an electrically conductive support base 23 that rests on and is electrically connected to an electrically conductive turret section 20. In the illustrated embodiment, turret section 20 rotates with respect to, is mounted on, and is electrically connected to, a flat electrically conductive surface 4, such as the deck of a ship. The FIG. 7 embodiment illustrates the rails 14,6 passing through an "open" contact area in the region of the base 23.

In the embodiment illustrated in FIG. 8, on the other hand, electrically conductive clamping member 24 surrounds the barrel sections 13 and rails 14,6 in the region of the base 23, forming a full "closed" contact area (aperture). In other respects, FIG. 8 is identical to FIG. 7. The magnetic field geometry in the gun bore 11 is the same for the FIGS. 7 and 8 embodiments. This has been confirmed experimentally.

FIG. 9 is identical to FIG. 8, except that a dielectric shell 10 has been added. Shell 10 has the same outer dimensions as clamping member 24, is hollow, extends along the entire length of the railgun 1, and surrounds all the other components in the system, including retention frames 32. Shell 10 allows the magnetic field to escape into the region outside of the barrel 13 region and therefore maintain a high L'. This protects the rails 14,6 from the surrounding environment. It also allows the rail 14,6 region to be filled with an inert gas, such as helium, nitrogen, or argon. This prevents the hot liquid metal, mostly aluminum, that is jetted from the armature 30/rail 14,6 interface from immediately bursting into flames all along the gun bore 11 as the armature 30 accelerates through the bore 11. The jetted metal can collect and solidify on the dielectric 10 cover, which can be easily replaced as required.

Figure 10:
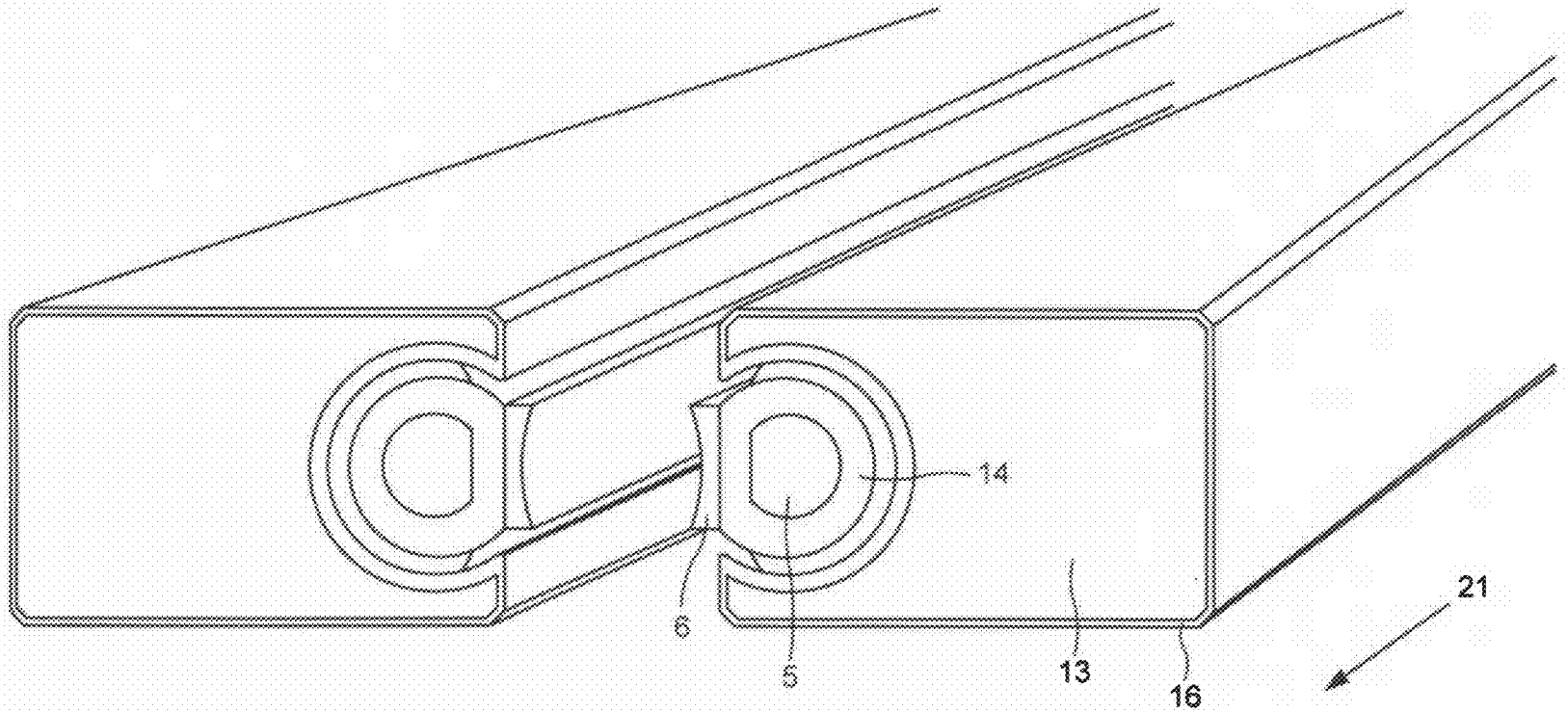
FIG. 10 is a modification of the FIG. 1 embodiment in which the barrel sections 13 are tapered, and the cross-section of each barrel section 13 is a non-square rectangle.

FIG. 10 illustrates an alternative embodiment that differs from the FIG. 1 embodiment in two respects: first, the cross-section of each barrel section 13 is not a square, but rather a non-square rectangle. This technique can be fruitfully used to add additional mass to the structure, e.g., for reasons of increased mechanical support. The second difference in this FIG. 10 embodiment is that the barrel sections 13, when viewed from the top or the bottom, are tapered, with these sections 13 being wider at the breech end 21 than at the muzzle end 22. The purpose of the tapering is to extend the length of the bore 11 compared with a non-tapered design. Lengthening the bore 11 can advantageously cause either a higher exit velocity for the projectile 31 for a given set of design parameters, or, alternatively, a relaxation in these design parameters for a given exit velocity. This tapering technique can be used with all of the embodiments of the present invention that are described herein.

Figure 11:
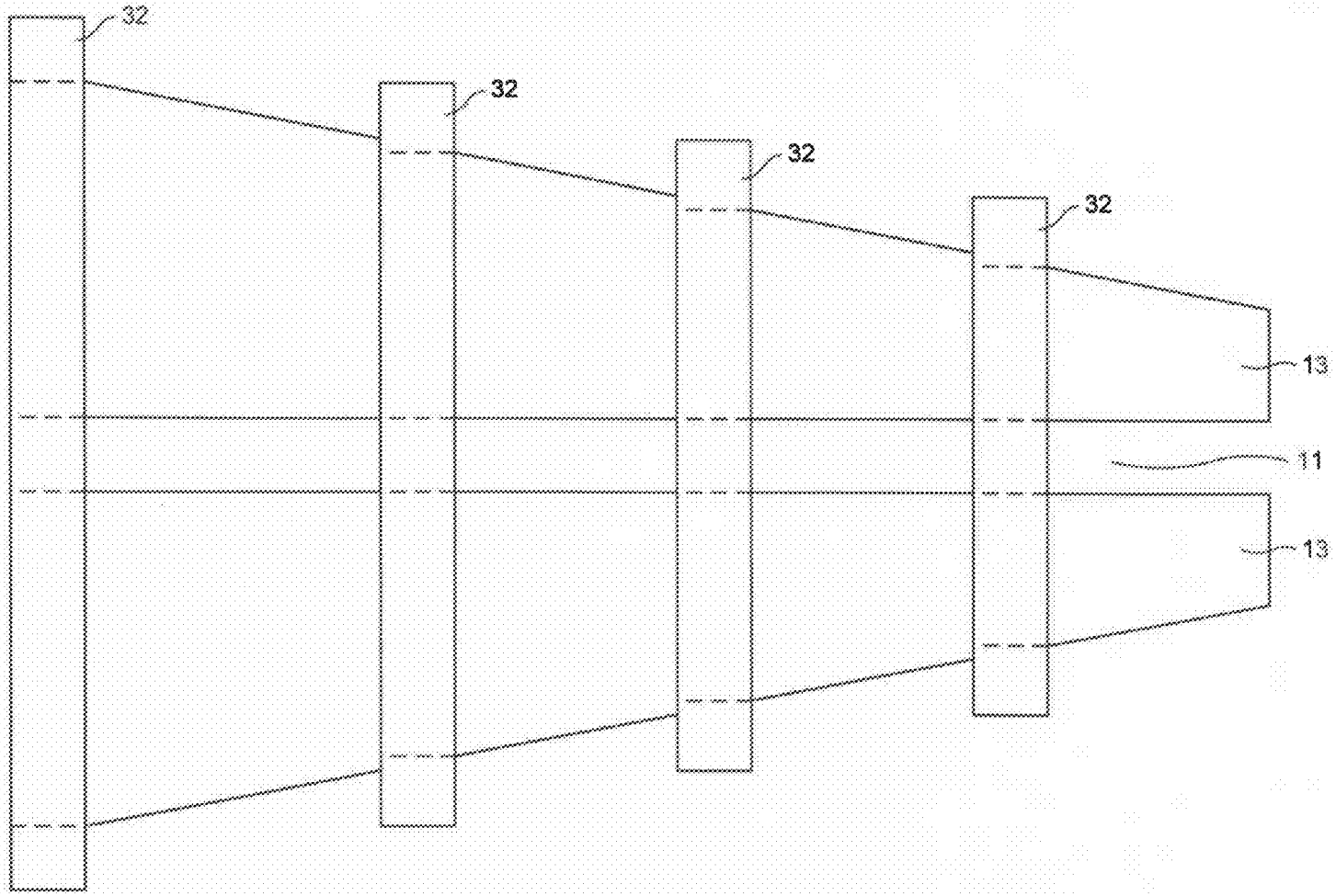
FIG. 11 is a top view of the FIG. 10 embodiment.

FIG. 11 is a top view of this tapered alternative embodiment, with the retention frames 32 being oriented orthogonal to the gun bore 11 axis. Note that the tapering is stepwise rather than continuous, i.e., there is no tapering where the retention frames 32 are located. This is done for ease of mechanical assembly and for increased mechanical strength.

Second Principal Embodiment

Because of the relatively large cross-sectional size of the conducting rails 14 in the embodiment illustrated in FIGS. 1 through 6, the inductance per unit length (L') was limited from 0.4 uH/m to 0.47 uH/m for a bore 11 spacing of between 30 cm and 40 cm. The current carrying rail 14 size was made large, in part to accommodate the substantial open channel 5 interior to the rail part 14 used to flow cooling fluid through the rails 14,6 (or sections thereof). It is primarily through the reduction in the cross-sectional size of the rail part 14 that further reductions in L' can be attained. It is the objective of the embodiment illustrated in FIGS. 12 through 16 to increase the inductance per unit length (L' in units of uH/m). Inductance per unit length in the range of 0.6 uH/m is desirable. This second principal embodiment can achieve this goal.

Figure 12:
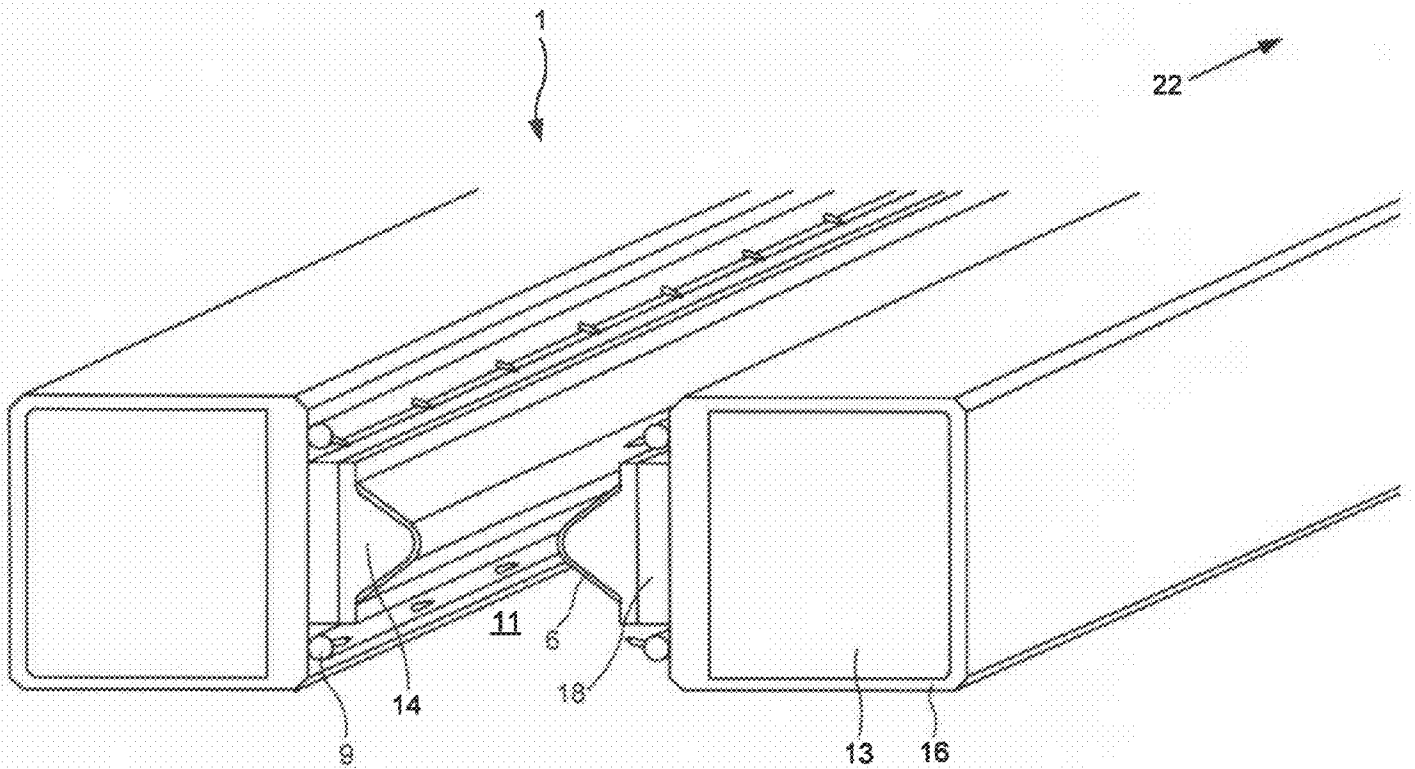
FIG. 12 is an isometric view of a second embodiment of the railgun 1 of the present invention.

In this second principal embodiment, a reduction in the size of the rail 14,6 is achieved by eliminating the interior cooling channel 5, and moving the rail 14,6 to the outer surface of the steel barrel section 13. Cooling of the rails 14,6 can be achieved by use of a water (or other evaporative fluid) spray directed to the outer surfaces of the rails 14,6 after each shot. As shown in FIG. 12, this fluid spray can flow through a plurality of nozzles 9 fabricated on at least one inside surface of a barrel section 13, above and/or below the rail 14,6. The nozzles 9, part of the thermal management system, carry water or other coolant for the rails 14,6 and are usually pointed in the direction of the rails 14,6.

FIG. 12 shows an isometric view of the second principal embodiment. The spacing between the rails 14,6 is 30 cm for the particular design used to calculate results discussed here, including the inductance (L'=0.55 uH/m), and the magnetic computational outputs presented below. The results presented are not optimized at the system level. For example, with all else being held constant, if the gun bore 11 is increased from 30 cm to 40 cm, L' increases from 0.55 uH/m to 0.63 uH/m.

This second principal embodiment is also a two-rail 14,6 system. Current is carried along the first rail 14,6 conducted across the moving armature 30, and then returned in the opposite direction along the second, parallel, and opposing rail 14,6. Each rail 14 typically consists of a single part made of copper, copper alloy, tungsten copper alloy, tungsten copper eutectic, or a similar wear-resistant but highly electrically conductive material. Alternatively, a wear-resistant cap 6 can be fabricated onto primary rail part 14, as shown in FIG. 12. Cap 6 is typically fabricated of steel, tungsten alloy, tungsten copper eutectic, or tungsten copper alloy.

Because of the design simplicity in this embodiment, the rail 14,6 can be made to be removable from the barrel 13 to facilitate easy replacement of the rail 14,6.

Figure 13:
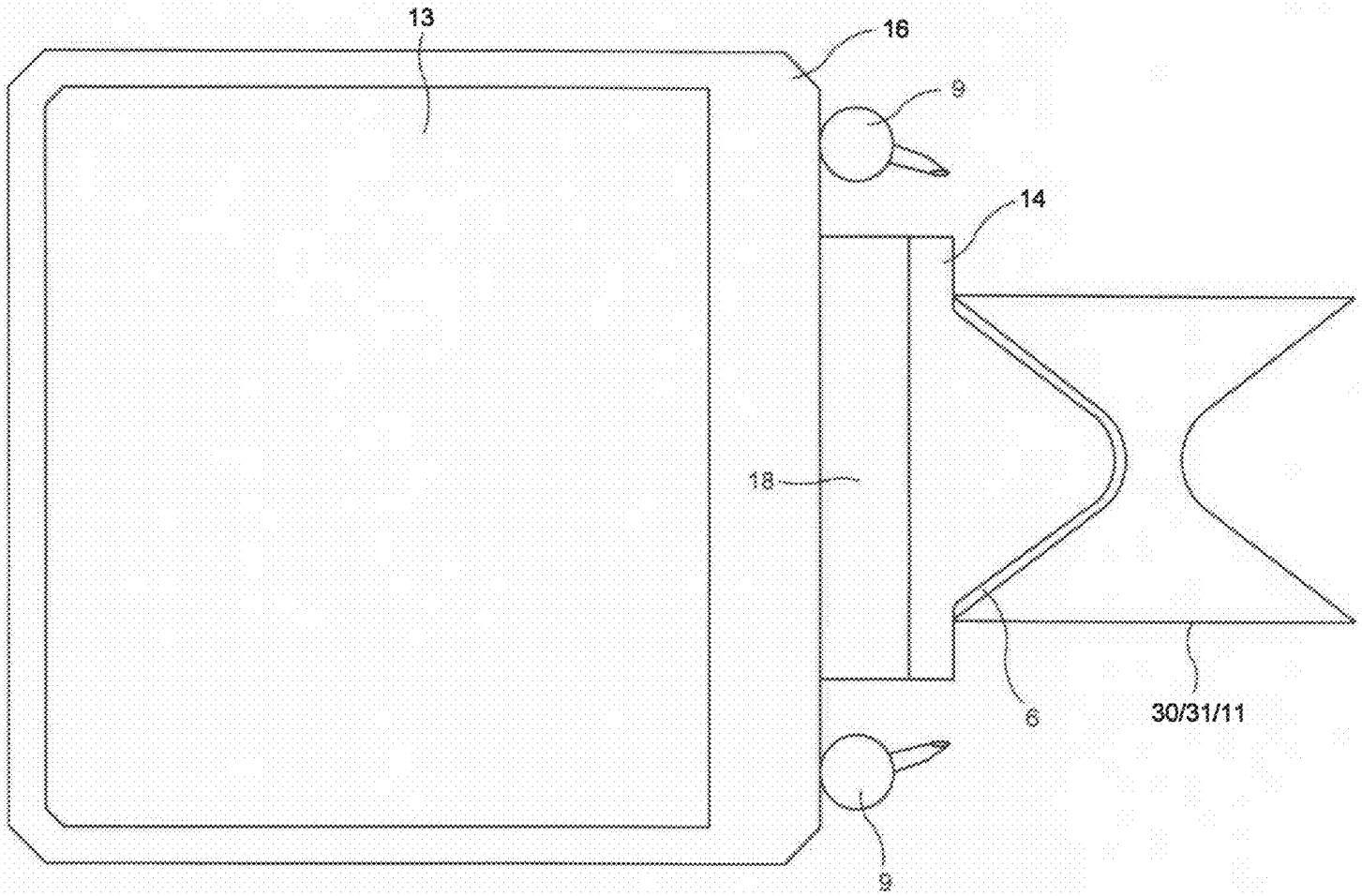
FIG. 13 is a cross-sectional view of the barrel section 13 of FIG. 12.

Shown in FIG. 13 is a detailed view of a gun barrel section 13 and its attached current carrying rail 14,6. Typical dimensions are 52 cm by 50 cm for the cross-section of barrel section 13, and 8 cm for the thickness of insulator 18. These dimensions are self-consistent with the inductance calculation results noted above.

The region between each current carrying rail 14,6 and its associated barrel section 13 is filled with a dielectric 18. Kevlar is the dielectric 18 of choice, though Phenolic, ceramic, or a ceramic composite can be used. The geometry is designed such that there is no direct line of sight between the insulator 18/air interface and the sliding contact region between the rail 14,6 and the armature 30. This geometry advantageously prevents direct UV illumination of these surfaces. It also prevents direct liquid metal (emanating from the sliding contact 14,6,30) or other direct sputtering or evaporative induced coating onto the insulator 18 surface. Additional baffles can be added to further protect the insulator 18 if required.

Each rail 14,6 is convex in shape from the point of view of the bore 11. This allows for mechanically secure capture and guidance of the armature 30 and any payload 31 along the gun bore 11. The top and bottom portions of each rail part 14 are made to be vertical, to redirect the jetted liquid metal from the sliding rail 14,6/armature 30 interface away from the insulator 18 region and directly out of the gun bore 11.

Figure 14:
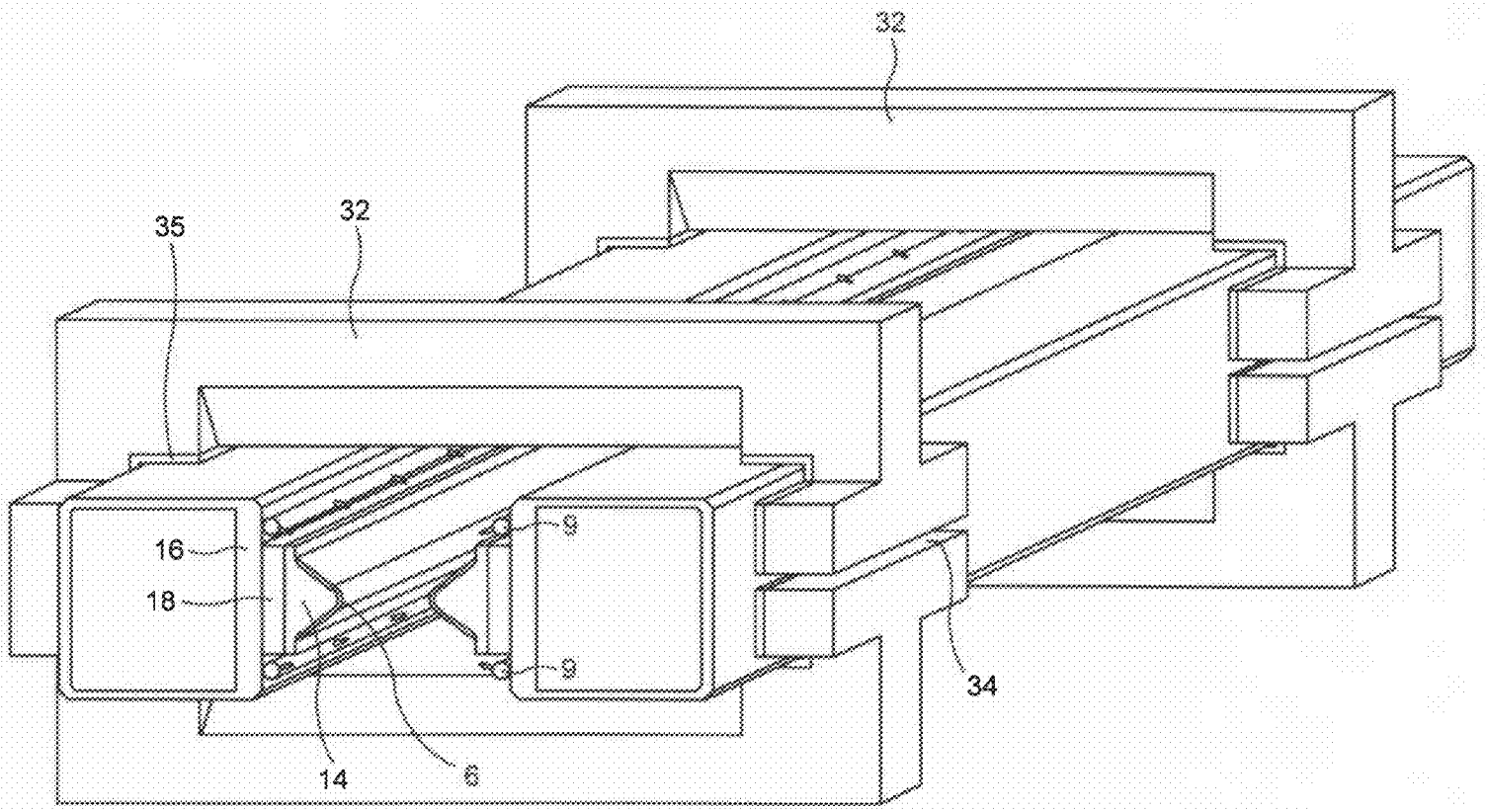
FIG. 14 is an isometric view of the FIG. 12 embodiment showing the use of retention frames 32.

FIG. 14 shows a partial assembly of the barrel 13 at a region other than the base 23 and turret 20. This includes the current carrying rails 14,6, barrel sections 13, and now the retention frames 32 that mostly encircle the rail 14,6 and barrel 13 assemblies. FIG. 14,6 shows two of the retention frames 32 that hold the two barrel sections 13 in place during a shot. All inward facing surfaces of the retention frames 32 that would otherwise come in contact with the barrel sections 13 are lined with Kevlar or other suitable dielectric 35. This is to prevent the electrical interconnection of the two barrel sections 13 with each other at all but one region along the length of the railgun 1. (For the embodiment where the barrel sections 13 are floating, there is no region where the barrel sections 13 are electrically interconnected.) These dielectric sections 35, like dielectrics 18, are always under compression.

The pitch of the retention frames 32 (distance between adjacent frames 32) is large compared to the thickness of each frame 32. This is done so as not to reduce the inductance appreciably. This is also a weight-saving feature and is made possible for two reasons. First, the frame 32 height can be increased as necessary to insure that the induced stress in the frame 32 due to the rail 14,6 current-induced magnetic pressure is well within the stress limit of the steel or other strong material that frame 32 is made of. Second, the barrel sections 13 are substantial in physical size, and themselves help to prevent outward deflection of the rails 14,6 in zones between each pair of retention frames 32.

Magnetic Analysis

Figure 15:
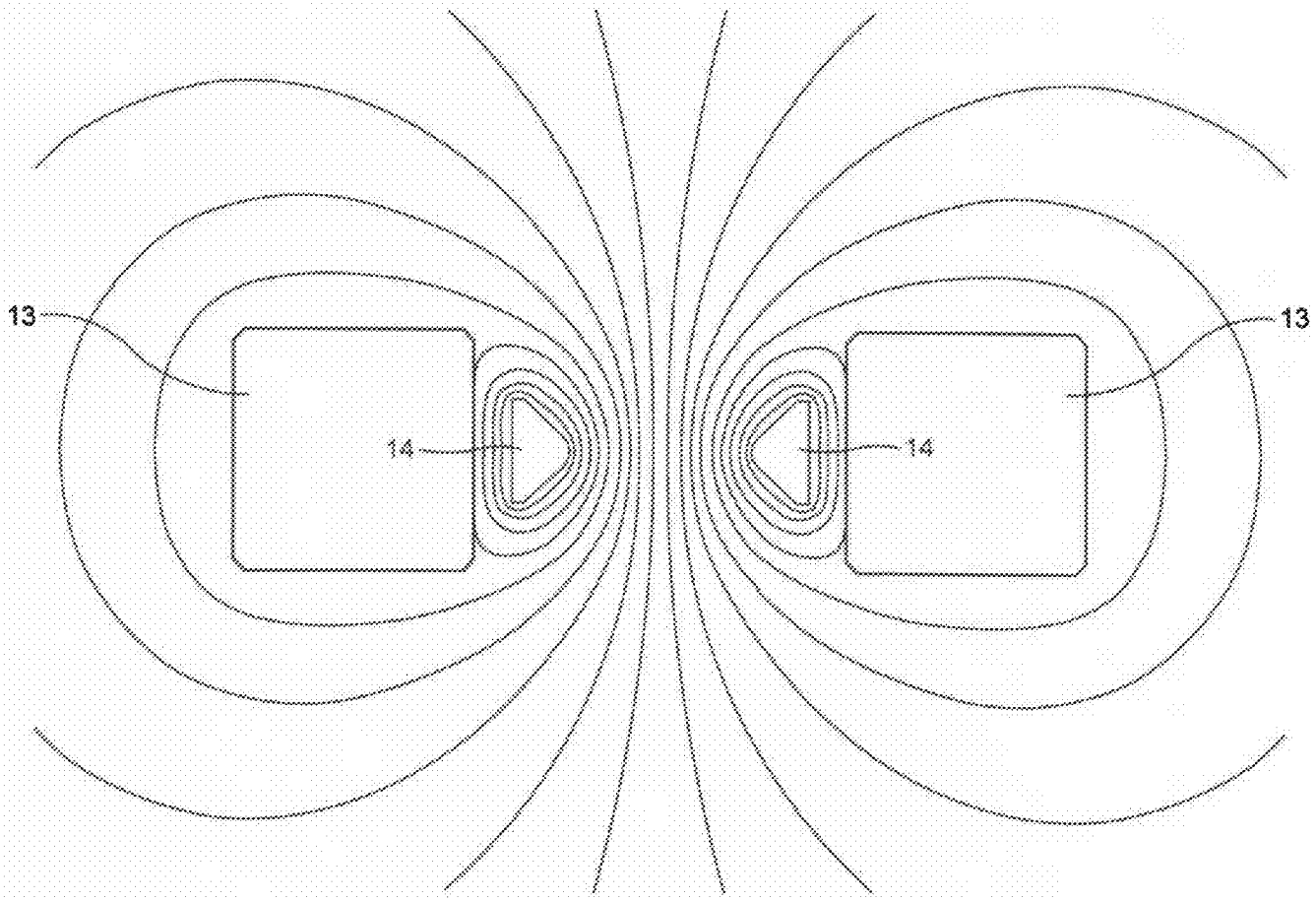
FIG. 15 is a magnetic field line plot for the FIG. 12 embodiment.

FIG. 15 shows a two-dimensional magnetic field line plot in which the two barrel sections 13 are electrically connected to each other at the gun base 23 only. The two barrel sections 13 remain electrically isolated from each other everywhere else along the gun barrel 13 length, from the breech 21 to the muzzle 22. Physically, this means that the two barrel sections 13 are mechanically secured to the base 23 with direct metal-to-metal connections. The retention frames 32 were not included in the computer run upon which FIG. 15 is based. Their inclusion would alter the results by approximately 2% to 3%. This field line plot was taken 100 micro-seconds into the pulse. Copper was used to simulate steel as the material for the barrel sections 13. This simulated the copper linings 16 that are typically used around the barrel 13 walls.

Figure 16:
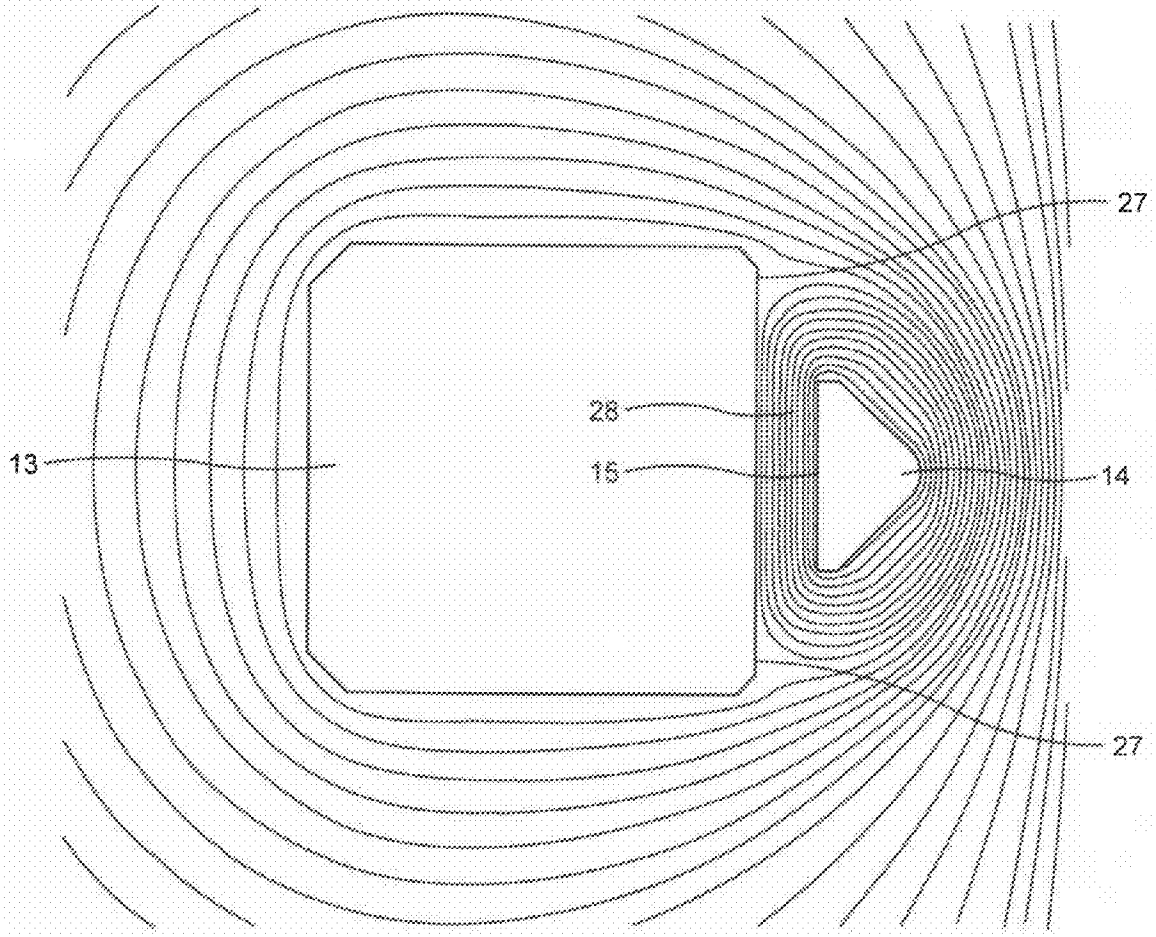
FIG. 16 is a closeup of a portion of the magnetic field line plot of FIG. 15.

FIG. 16 shows an enlargement of the space around one of the current carrying copper rails 14. The field line density has been increased to show more precisely where the surface currents flow. Drive currents flow on surfaces of the copper rail 14, and image currents flow on surfaces of the barrel 13. Once the armature 30 has passed, a percentage of the rail 14 current is drawn onto the back rail surface 15 and into the gap 28 between the rail 14 and the barrel section 13. By proper design, the rail 14 current is distributed uniformly over the entire surface area of the rail 14. This advantageously minimizes energy dissipation in the rail 14.

Each separatrix 27 shown in FIG. 16 denotes the location on the barrel 13 surface where the surface current changes direction. These currents reconnect at the base 23 region, where the rail 14 currents originate, and in the vicinity of the armature 30. Energy flow into the combined copper rail 14 and copper lining 16 can be relatively low, as compared with existing railgun designs. In addition, this design allows for multiple firings with minimal degradation of the rails 14,6, as the rails 14,6 can be actively cooled using fluid jet techniques.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the present invention. For example, in the two principal embodiments included in the above description, the barrel sections 13 had a square or non-square rectangular cross-section. However, the barrel sections can have any number of cross-sections 13, including but not limited to triangular, circular, elliptical, or trapezoidal. Similarly, the cross-sections of the current carrying rails 14 are not limited to any specific shapes or sizes.

What is claimed is:

1. An elongated non-augmented electromagnetic railgun adapted to propel a moving armature through a bore along the length of the railgun from its breech end to its muzzle end, said railgun comprising:

two elongated mechanically rigid electrically conductive barrel sections, said sections being spaced apart from each other along the length of the railgun; and mechanically coupled via a dielectric to each barrel section, and completely electrically insulated therefrom, an elongated current carrying rail for providing electromagnetic propulsive force to the armature, said two rails facing each other across an elongated open channel defining the bore; wherein:

the two barrel sections are electrically connected to each other at a maximum of one location of the railgun, the barrel sections not providing any positive electromagnetic propulsive force to the armature;

wherein each rail comprises an elongated internal channel adapted to deliver coolant to interior surfaces of the rail; and each coolant channel is segmented along the length of its corresponding rail into regions, permitting cooling of the rail on a region-by-region basis.

2. The railgun of claim 1 wherein the two barrel sections are substantially identical to each other, and the two rails are substantially identical to each other.

3. The railgun of claim 1 wherein the barrel sections are fabricated of steel.

4. The railgun of claim 1 further comprising an elongated dielectric shell surrounding and spaced apart from the barrel sections and rails, said dielectric shell adapted to provide containment for an inert gas.

5. The railgun of claim 4 wherein the inert gas is from the group consisting of helium, nitrogen, and argon.

6. The railgun of claim 1 wherein the barrel sections are uniformly spaced apart from each other throughout the length of each railgun.

7. The railgun of claim 1 wherein the rails are fabricated of a material from the group consisting of copper, copper alloy, tungsten copper eutectic, and tungsten copper alloy.

8. The railgun of claim 1 wherein each barrel section has a generally rectangular cross section.

9. The railgun of claim 1 further comprising an elongated electrically conductive wear-resistant plate fabricated on a bore-facing outer surface of each rail.

10. The railgun of claim 9 wherein the plates are fabricated of a material from the group consisting of steel, tungsten alloy, tungsten copper eutectic, and tungsten copper alloy.

11. The railgun of claim 9 wherein several expansion slots are cut in each plate along the length of said plate, said slots adapted to compensate for different thermal expansion coefficients of the plate and its corresponding rail.

12. The railgun of claim 1 wherein each rail is recessed within its corresponding barrel section.

13. The railgun of claim 1 further comprising an elongated mechanically wear-resistant plate attached to an outer surface of each rail, wherein said plate has a concave shape with respect to the bore.

14. The railgun of claim 1 further comprising an electrically insulative material positioned between each rail and its corresponding barrel section.

15. The railgun of claim 14 wherein the electrically insulative material is fabricated of a material from the group consisting of Kevlar, ceramic, ceramic composite, and Phenolic.

16. The railgun of claim 1 wherein outer edges of the insulation material are open to ambient gases, and there is no direct line of sight between the electrically insulative material/ambient gas interface and the rail/armature interface.

17. The railgun of claim 1 further comprising electrically conductive linings on outer surfaces of the barrel sections, said linings fabricated of a material from the group consisting of copper and copper alloy.

18. The railgun of claim 1 further comprising several rigid retention frames positioned around the two barrel sections, said retention frames spaced apart along the length of the railgun.

19. The railgun of claim 18 wherein the retention frames are fabricated of steel.

20. The railgun of claim 18 further comprising a dielectric positioned between inner surfaces of the retention frames and outer surfaces of the barrel sections.

21. The railgun of claim 18 wherein inner surfaces of the retention frames that are positioned proximate the bore are beveled into sharp edges.

22. The railgun of claim 18 wherein the distance between adjacent retention frames is large compared to the thickness of each frame.

23. The railgun of claim 18 wherein a slot is cut completely through each retention frame.

24. An elongated non-augmented electromagnetic railgun adapted to propel a moving armature through a bore along the length of the railgun from its breech end to its muzzle end, said railgun comprising:

two elongated mechanically rigid electrically conductive barrel sections, said sections being spaced apart from each other along the length of the railgun; and mechanically coupled via a dielectric to each barrel section, and completely electrically insulated therefrom, an elongated current carrying rail for providing electromagnetic propulsive force to the armature, said two rails facing each other across an elongated open channel defining the bore; wherein:

the two barrel sections are electrically connected to each other at a maximum of one location of the railgun, the barrel sections not providing any positive electromagnetic propulsive force to the armature;

each rail is recessed within its corresponding barrel section;

each rail comprises an elongated internal channel adapted to deliver coolant to interior surfaces of the rail; and each coolant channel is segmented along the length of its corresponding rail into regions, permitting cooling of the rail on a region-by-region basis.

25. The railgun of claim 24 further comprising an elongated mechanically wear-resistant plate attached to an outer surface of each rail, wherein said plate has a concave shape with respect to the bore.

* * * * *